US007007443B2

(12) United States Patent
Liedtke et al.

(10) Patent No.: US 7,007,443 B2
(45) Date of Patent: Mar. 7, 2006

(54) SYSTEM AND METHOD FOR BANDOLIERING SYRINGES

(75) Inventors: Klaus Liedtke, Ormond Beach, FL (US); Dennis Tribble, Ormond Beach, FL (US)

(73) Assignee: ForHealth Technologies, Inc., Daytona Beach, FL (US)

( * ) Notice: Subject to any disclaimer, the term of this patent is extended or adjusted under 35 U.S.C. 154(b) by 0 days.

(21) Appl. No.: 10/874,701

(22) Filed: Jun. 22, 2004

(65) Prior Publication Data

US 2005/0039417 A1 Feb. 24, 2005

Related U.S. Application Data

(63) Continuation-in-part of application No. 10/626,506, filed on Jul. 23, 2003.

(60) Provisional application No. 60/483,531, filed on Jun. 27, 2003.

(51) Int. Cl.
*B65B 13/02* (2006.01)
*B65B 57/02* (2006.01)

(52) U.S. Cl. ..... 53/399; 53/505

(58) Field of Classification Search ..... 53/399, 53/398, 419, 443, 444, 446, 137.2, 450, 550, 53/551, 52, 500, 505
See application file for complete search history.

(56) References Cited

U.S. PATENT DOCUMENTS

| | | | |
|---|---|---|---|
| 2,627,470 | A | 2/1953 | Seiferth |
| 2,880,723 | A | 4/1959 | Adams |
| 2,981,432 | A | 4/1961 | Flood |
| 3,527,017 | A | 9/1970 | Taylor et al. |
| 3,611,656 | A | 10/1971 | Chidsey, Jr. |
| 3,651,615 | A | 3/1972 | Bohner et al. |
| 3,676,271 | A | 7/1972 | Hake et al. |
| 3,736,933 | A | 6/1973 | Szabo |
| 3,823,818 | A | 7/1974 | Shaw |
| 3,835,897 | A | 9/1974 | Gess |
| 3,878,026 | A | 4/1975 | Snyder et al. |
| 3,880,211 | A | 4/1975 | Gess |
| 4,472,357 | A | 9/1984 | Levy et al. |

(Continued)

FOREIGN PATENT DOCUMENTS

| | | |
|---|---|---|
| EP | 0042336 | 12/1981 |

(Continued)

OTHER PUBLICATIONS

U.S. Appl. No. 10/626,506, Osborne.

*Primary Examiner*—John Paradiso
(74) *Attorney, Agent, or Firm*—Darby & Darby

(57) ABSTRACT

The present invention provides an automated system and method of banding (bandoliering) a plurality of syringes. The system includes a feed device for receiving the plurality of syringe barrels and positioning the plurality of syringes according to a predetermined orientation and an indexed device for transferring the plurality of syringes in the predetermined orientation to a transport device that includes individual pockets for receiving and holding the syringes in a spaced relationship as the syringes are advanced due to movement of the transport device. The system also includes a web application device disposed along the transport device for applying a first web material to a first face of a predetermined number of syringes and a second web material to a second face of the syringes and being configured to press the first and second materials into contact with the first and second faces of the syringes, respectively, and into contact with each other in areas between the syringes so as to form a banded syringe structure.

48 Claims, 17 Drawing Sheets

U.S. PATENT DOCUMENTS

| | | | |
|---|---|---|---|
| 4,502,616 | A | 3/1985 | Meierhoefer |
| 4,512,472 | A | 4/1985 | Jarund |
| 4,512,475 | A | 4/1985 | Federighi |
| 4,624,148 | A | 11/1986 | Averette |
| 4,639,250 | A | 1/1987 | Rycroft |
| 4,674,652 | A | 6/1987 | Aten et al. |
| 4,702,788 | A | 10/1987 | Okui |
| 4,758,230 | A | 7/1988 | Rycroft |
| 4,823,982 | A | 4/1989 | Aten et al. |
| 4,865,592 | A | 9/1989 | Rycroft |
| 5,019,048 | A | 5/1991 | Margolin |
| 5,188,696 | A | 2/1993 | Good, Jr. |
| 5,337,636 | A | 8/1994 | Shea |
| 5,341,854 | A | 8/1994 | Zezulka et al. |
| 5,356,393 | A | 10/1994 | Haber et al. |
| 5,573,042 | A | 11/1996 | De Haen |
| 5,597,530 | A | 1/1997 | Smith et al. |
| 5,611,430 | A | 3/1997 | Albrecht et al. |
| 5,651,775 | A | 7/1997 | Walker et al. |
| 5,704,921 | A | 1/1998 | Carilli |
| 5,782,157 | A | 7/1998 | Ellington et al. |
| 5,884,457 | A | 3/1999 | Ortiz et al. |
| 5,887,722 | A | 3/1999 | Albrecht et al. |
| 5,893,259 | A | 4/1999 | Posge |
| 5,911,252 | A | 6/1999 | Cassel |
| 6,722,404 | B1 | 4/2004 | Osborne |
| 2002/0020459 | A1 | 2/2002 | Baldwin et al. |
| 2004/0088951 | A1 | 5/2004 | Baldwin et al. |

FOREIGN PATENT DOCUMENTS

| | | |
|---|---|---|
| EP | 021800 | 4/1987 |
| WO | WO-98/32690 | 7/1998 |
| WO | 0935969 | 8/1999 |

120
122
126
127
127
124
143
142
140
to Station 160

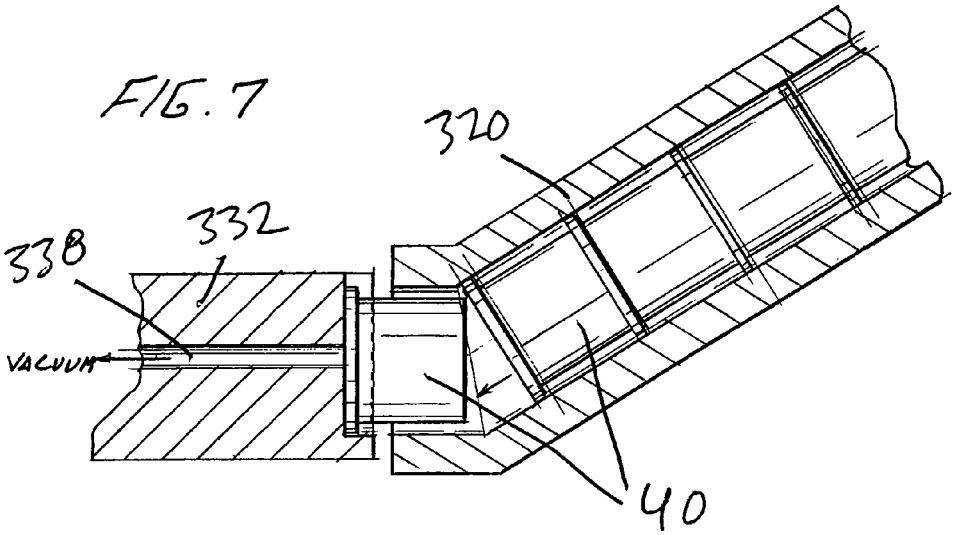
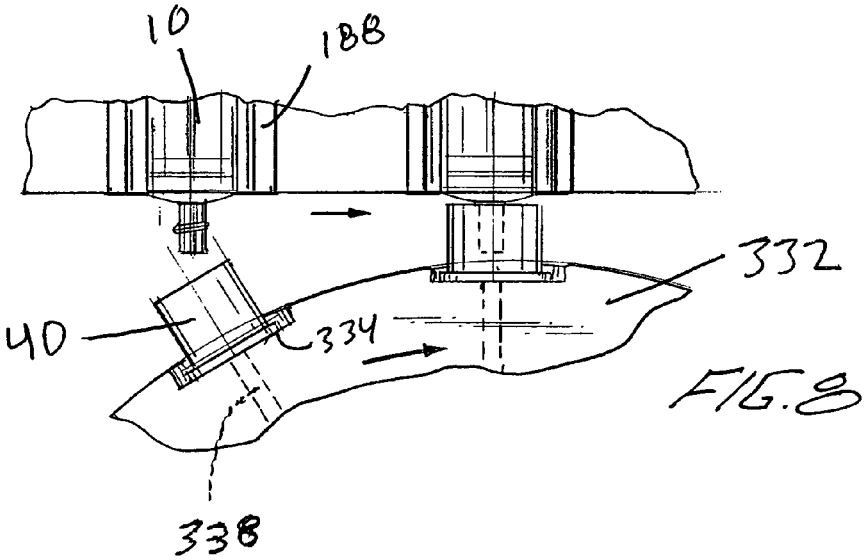
FIG. 8
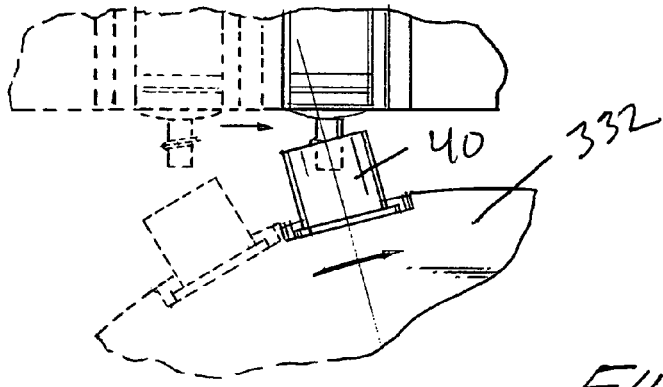
FIG. 9

KNIFE CONTROL
SCANNER CONTROL
420
410
422
400
500
10
350
188
187
550

KNIFE CONTROL
SCANNER CONTROL
420
400
410
500
422
187
550

SYSTEM AND METHOD FOR BANDOLIERING SYRINGES

CROSS-REFERENCE TO RELATED APPLICATION

This patent application is a continuation-in-part of U.S. patent application Ser. No. 10/626,506, filed Jul. 23, 2003, which claims the priority of U.S. provisional patent application No. 60/483,531, filed in the U.S. Patent and Trademark Office on Jun. 27, 2003, both of which are incorporated herein by reference.

TECHNICAL FIELD

The present invention relates generally to the handling of syringes, and more particularly, to an automated system and method for preparing a batch of joined syringes by a banding (e.g., bandoliering) operation.

BACKGROUND

Disposable syringes are in widespread use for a number of different types of applications. For example, syringes are used not only to withdraw a fluid (e.g., blood) from a patient but also to administer a medication to a patient. In the latter, a cap or the like is removed from the syringe and a unit dose of the medication is carefully measured and then injected or otherwise disposed within the syringe.

As technology advances, more and more sophisticated, automated systems are being developed for preparing and delivering medications by integrating a number of different stations, with one or more specific tasks being performed at each station. For example, one type of exemplary automated system operates as a syringe filling apparatus that receives user inputted information, such as the type of medication, the volume of the medication and any mixing instructions, etc. The system then uses this inputted information to disperse the correct medication into the syringe up to the inputted volume.

In some instances, the medication that is to be delivered to the patient includes more than one pharmaceutical substance. For example, the medication can be a mixture of several components, such as several pharmaceutical substances.

By automating the medication preparation process, increased production and efficiency are achieved. This results in reduced production costs and also permits the system to operate over any time period of a given day with only limited operator intervention for manual inspection to ensure proper operation is being achieved. Such a system finds particular utility in settings, such as large hospitals, that require a large number of doses of medications to be prepared daily. Traditionally, these doses have been prepared manually in what is an exacting but tedious responsibility for a highly skilled staff. In order to be valuable, automated systems must maintain the exacting standards set by medical regulatory bodies, while at the same time simplifying the overall process and reducing the time necessary for preparing the medications.

Because syringes are often used as the carrier means for transporting and delivering the medication to the patient, it is advantageous for these automated systems to be tailored to accept syringes. However, the previous methods of dispersing the medication from the vial and into the syringe were very time consuming and labor intensive. More specifically, medications and the like are typically stored in a vial that is sealed with a safety cap or the like. In conventional medication preparation, a trained person retrieves the correct vial from a storage cabinet or the like, confirms the contents and then removes the safety cap manually. This is typically done by simply popping the safety cap off with ones hands. Once the safety cap is removed, the trained person inspects the integrity of the membrane and cleans the membrane. An instrument, e.g., a needle, is then used to pierce the membrane and withdraw the medication contained in the vial. The withdrawn medication is then placed into a syringe to permit subsequent administration of the medication from the syringe.

Typically, the medication is placed in the syringe when the needle is in place and secured to the barrel tip by drawing the medication through the needle and into the syringe barrel. Such an arrangement makes it very difficult for this type of syringe to be used in an automated system due to the fact that medication is drawn through the small needle into the syringe barrel and therefore this operation is a very time and labor intensive task. What is needed in the art and has heretofore not been available is a system and method for automating the medication preparation process and more specifically, an automated system and method for preparing a syringe including the automated removal, parking, and replacement of a tip cap of the syringe.

Over the years, automated systems have been proposed to prepare batches of syringes that are interconnected in some manner so that the syringes can be fed to another apparatus for further processing of the syringes. In other words, the syringes can be fed in an automated manner to an apparatus that then prepares and delivers prescribed contents (medication) to the syringe. For example, U.S. Patent Application Publication No. 2002/0020459 discloses an apparatus for handling a plurality of syringe bodies which are interconnected to one another by a belt such that the syringe bodies lie in a predetermined orientation, with a predetermined spacing therebetween. This particular apparatus is configured such that a first tape is fed to a wheel which receives and holds syringe bodies in notches formed therein. The first tape is placed in contact with the syringe bodies so that the syringe bodies contact the adhesive side of the first tape and are therefore adhesively secured thereto. As the wheel rotates, it carries the syringes in contact with the first tape to a position where the syringes come into contact with an adhesive side of a second tape, which is simultaneously being unwound from a roll. In this manner, the first and second tapes get adhered to diametrically opposite sides of the syringes. The syringes are then fed to a press wheel that rotates to press the tape strips to each other between the syringes. The syringes are positioned in the band or belt (i.e., the joined first and second tapes) in a common orientation, i.e., with the luers of all the syringes on the same side of the band. While, this particular apparatus is satisfactory for its intended purpose, the apparatus suffers from a number of deficiencies. For example, the syringe bodies are first adhesively secured to one tape and then brought into contact with another tape before the two tapes are pressed together around the syringe bodies. Thus, because the first and second tapes are fed at different stations and contact the syringe bodies at different times, there is a chance that the first and second tapes can become misaligned resulting in the two tapes not perfectly seating against one another.

Thus, what is needed is an alternative way of handling syringes and more particularly, an apparatus and method of bandoliering syringes using an automated system.

SUMMARY

The present invention provides an automated system and method of banding (bandoliering) a plurality of syringes. The system includes a feed device for receiving the plurality of syringe barrels and positioning the plurality of syringes according to a predetermined orientation and an indexed device for transferring the plurality of syringes in the predetermined orientation to a transport device that includes individual pockets for receiving and holding the syringes in a spaced relationship as the syringes are advanced due to movement of the transport device. The system also includes a web application device disposed along the transport device for applying a first web material to a first face of a predetermined number of syringes and a second web material to a second face of the syringes and being configured to press the first and second materials into contact with the first and second faces of the syringes, respectively, and into contact with each other in areas between the syringes so as to form a banded syringe structure.

In one exemplary embodiment, the first and second web materials are single side adhesive tapes. Both the indexed device and the transport device have individual pockets or receiving areas for holding and retaining a single syringe during the advancement of the syringe to the web application device with the spacing of the transport device corresponding to the spacing between the syringes in the final banded structure. The present system is configured so that two web materials are simultaneously applied to the opposite faces of the syringes and otherwise brought into a banded construction.

In one exemplary embodiment, the system includes (1) a feed device for receiving the plurality of syringe barrels and positioning the plurality of syringes according to a predetermined orientation and (2) an indexed device for transferring the plurality of syringes in the predetermined orientation to a moving belt assembly that includes individual pockets for receiving and holding the syringes in a spaced relationship as the syringes are advanced due to movement of the belt assembly. The system also includes a web application device that is formed of at least two cam press units that are disposed on opposite sides of the belt assembly such that the two cam press units simultaneously apply at the same location a first web material against a first face of the syringes and a second web material against a second face of the syringes as well as pinching the web materials into contact with each other in areas between the syringes so as to form the banded syringe structure. The at least two cam press units move in a synchronized reciprocating cyclical manner and in a direction that is substantially perpendicular to a direction of travel of the syringes carried by the belt assembly, whereby the continuous movement of the syringes and the reciprocating action of the cam press units results in the web materials being pinched together at locations between the syringes and rolled and adhered along the faces of the syringe to produce the banded structure. The system further optionally includes (4) a cap placement station having an automated device for placing caps on empty barrels of the syringes that are fed into the feed device and then delivered to the belt assembly via the indexed device.

Further aspects and features of the exemplary bandoliering system and method disclosed herein can be appreciated from the appended Figures and accompanying written description.

BRIEF DESCRIPTION OF THE DRAWINGS

FIG. 7 is an enlarged cross-sectional partial view of a cap loading portion of the cap placement station;

FIG. 8 is an enlarged cross-sectional partial view of the interface between the rotary dial of the cap placement station and the transportation mechanism where mating between the cap and the empty syringe occurs and is shown in a first position;

FIG. 9 is an enlarged cross-sectional view of the cap placement station of FIG. 8 with the cap and the empty syringe being shown in a second position;

DETAILED DESCRIPTION OF PREFERRED EMBODIMENTS

Figure 15:
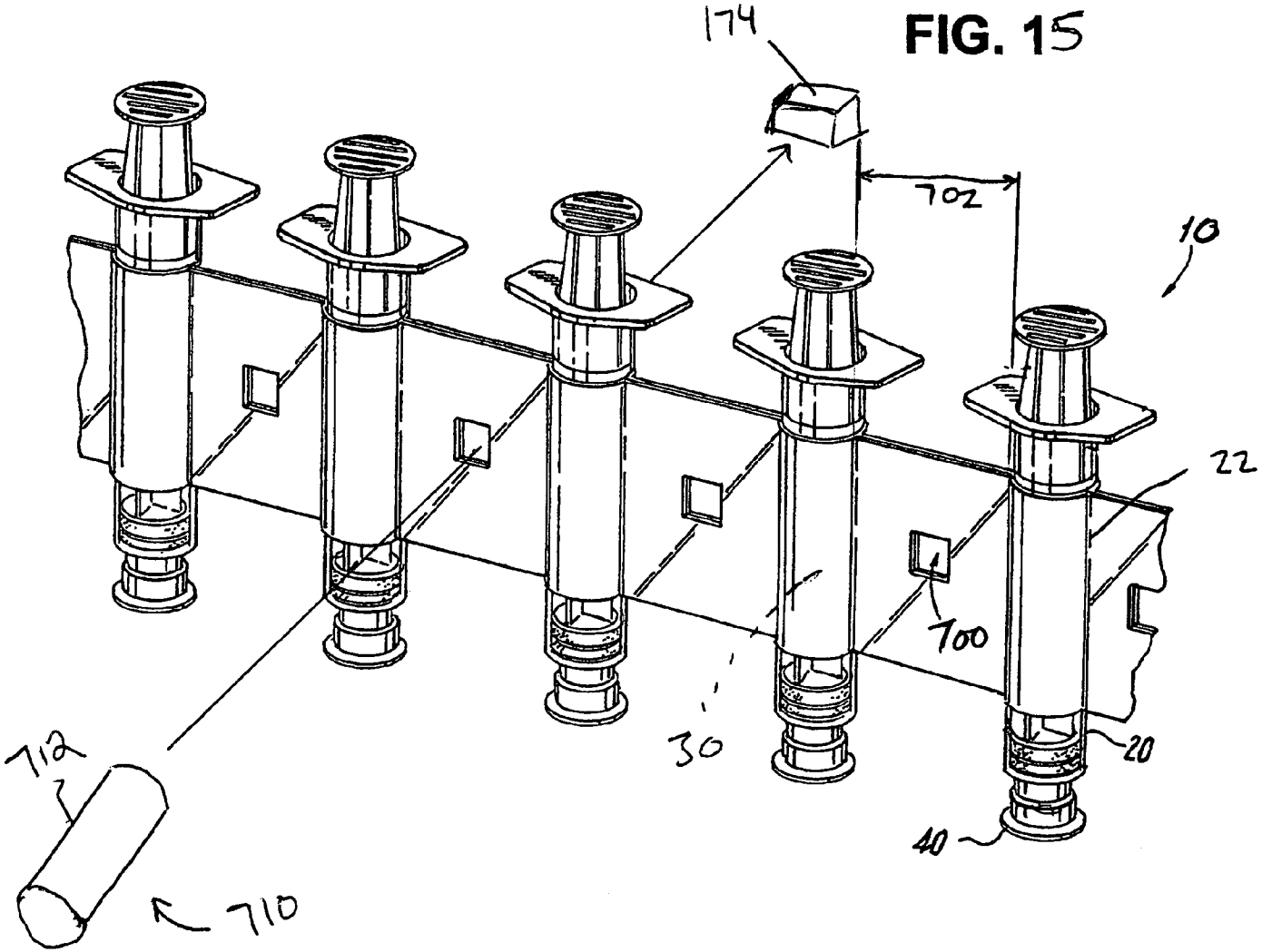
FIG. 15 is a side perspective view of a section of banded syringes with a control feature according to a first embodiment.

FIG. 15 illustrates an exemplary banded syringe structure produced in accordance with the present invention and includes a plurality of syringes 10 that each includes a barrel 20 having an elongated body 22 that defines a chamber 30 that receives and holds a medication that is disposed at a later time. The tip cap 40 thus must have complementary fastening features that permit it to be securely coupled to the barrel tip. The tip cap 40 is constructed so that it closes off the passageway to permit the syringe 10 to be stored and/or transported with a predetermined amount of medication disposed within the chamber 30. As previously mentioned, the term "medication" refers to a medicinal preparation for administration to a patient and most often, the medication is contained within the chamber 30 in a liquid state even though the medication initially may have been in a solid state, which was compounded into a liquid state.

The banded syringes 10 can include a control feature 700 such as the ones disclosed in commonly assigned pending U.S. patent application Ser. No. 10/001,244, filed Nov. 15, 2001, entitled "Syringe Bandolier with Control Feature", which is hereby incorporated by reference in its entirety.

The control feature 700 ensures that the banded syringes 10 is properly aligned in a system that it is being used in, such as the disclosed automated system 1000, and also to ensure that the syringes have specifications, e.g., dimensions, that fall within the acceptable specifications of the system with which the banded syringes 10 are being used. The control feature 700 is formed in each prescribed interval 702 between next adjacent syringes. The control feature 700 is configured so that a detection mechanism, such as a reader or other type of similar device, can detect the presence or absence, as well as the location of the control feature 700 within the prescribed interval 702.

In one embodiment, the control feature 700 is an aperture formed in the prescribed interval 702 at a specific location thereof. For example, the control feature 700 can be in the form of an aperture having a square shape as shown in FIG. 15. The system 1000 (FIG. 16) typically includes a laminar flow of air about the stations and rotary apparatus 1030 to ensure that the system 1000 is clean and remains in a clean state during operation. In a first embodiment, a detection mechanism 710 takes advantage of the presence of this laminar air flow by incorporating a nozzle 712 into the components providing the laminar air flow in the system 1000. The nozzle discharges a laminar air flow and if the banded syringes 10 is precision fed into the system 1000, proper alignment of the control feature 700 results and hence the syringe can be ascertained by having the laminar air flow directed toward the banded syringes 10 at the same height as the height that the control feature 700 is formed in the prescribed interval 702. In other words, the laminar air flow is in registration with the control feature 700 at select times when the aperture and the laminar air flow align with one another. When the control feature 700 (aperture) and the laminar air flow are not in alignment, the laminar air flow simply strikes the strip and does not pass therethrough.

In this embodiment, the detection mechanism 710 also includes a sensor 714 that is disposed on the opposite side of the banded syringes 10 as compared to the nozzle 712. The sensor 714 is configured to detect the presence of the laminar air flow when the aperture and laminar air flow are in alignment. In this instance, the sensor 714 is of a type that detects the presence of the laminar air flow against the sensor 714 itself and in one embodiment, the sensor is a pressure sensor. When the laminar air flow and the control feature 700 are in registration, the laminar air flow is permitted to flow cleanly through the aperture formed in the banded syringes 10 and make contact with the sensor. The sensor detects the presence of the laminar air flow and signals a controller (not shown) or the like of such detection. The controller is integrated into the system 1000 such that upon receiving this signal, the controller then signals other components, such as the rotary apparatus 1030, of the system 1000 to advance the banded syringes 10 a prescribed distance. It should be understood that the controller can respond to the pressure of the air flow through the control feature 700 or to a logical waveform resulting from the timing of air signals relative to periods without air signals (e.g., due to indexing of the banded syringes 10).

Once the banded syringes 10 is advanced the prescribed distance, another of the apertures (control feature 700) is then axially aligned with the laminar air flow so long as the correct type of banded syringes 10 for the system 1000 is in place, the syringe orientation (up or down) is proper, and also the alignment of the banded syringes 10 is proper. By integrating the detection mechanism 71 with the indexing components of the system 1000, the distance between the control features 700 corresponds to the distance that the banded syringes 10 is advanced upon receiving the control signal from the detection mechanism 710. Thus, the banded syringes 10 is continuously advanced because each time the detection mechanism 710 is in recognition with the control feature 700, the banded syringes 10 is advanced a distance that corresponds to the next control feature 700 being within a detection zone, thereby resulting in the detection mechanism 710 detecting the next control feature 700 and signaling the system 1000 to further advance the banded syringes 10.

It will be appreciated that the system 1000 can thus easily be designed so that the banded syringes 10 is continuously fed into the system 1000, thereby permitting the system 1000 to run continuously. The control feature 700 ensures proper alignment of the banded syringes 10 and also ensures that the proper type of banded syringes 10 is being used as the system 1000 is configured to stop advancing the banded syringes 10 if the detection mechanism 710 fails to read the control feature 700. For example, if the correct banded structure 10 is being used but the banded structure 10 becomes misaligned as it is being fed, the control feature 700 will not be in alignment with the nozzle as the banded syringes 100 are advanced. The detection mechanism 710 is preferably configured so that it will only advance the banded syringes 10 a predetermined distance without detecting the control feature 700. If the control feature 700 is not detected over this predetermined distance, the detection mechanism 710 signals the controller or the like of the system 1000 to stop advancement of the banded syringes 10. Preferably, an error message is generated at the same time the banded syringes 10 is stopped. Manual inspection is then performed to locate the problem.

Figure 17:
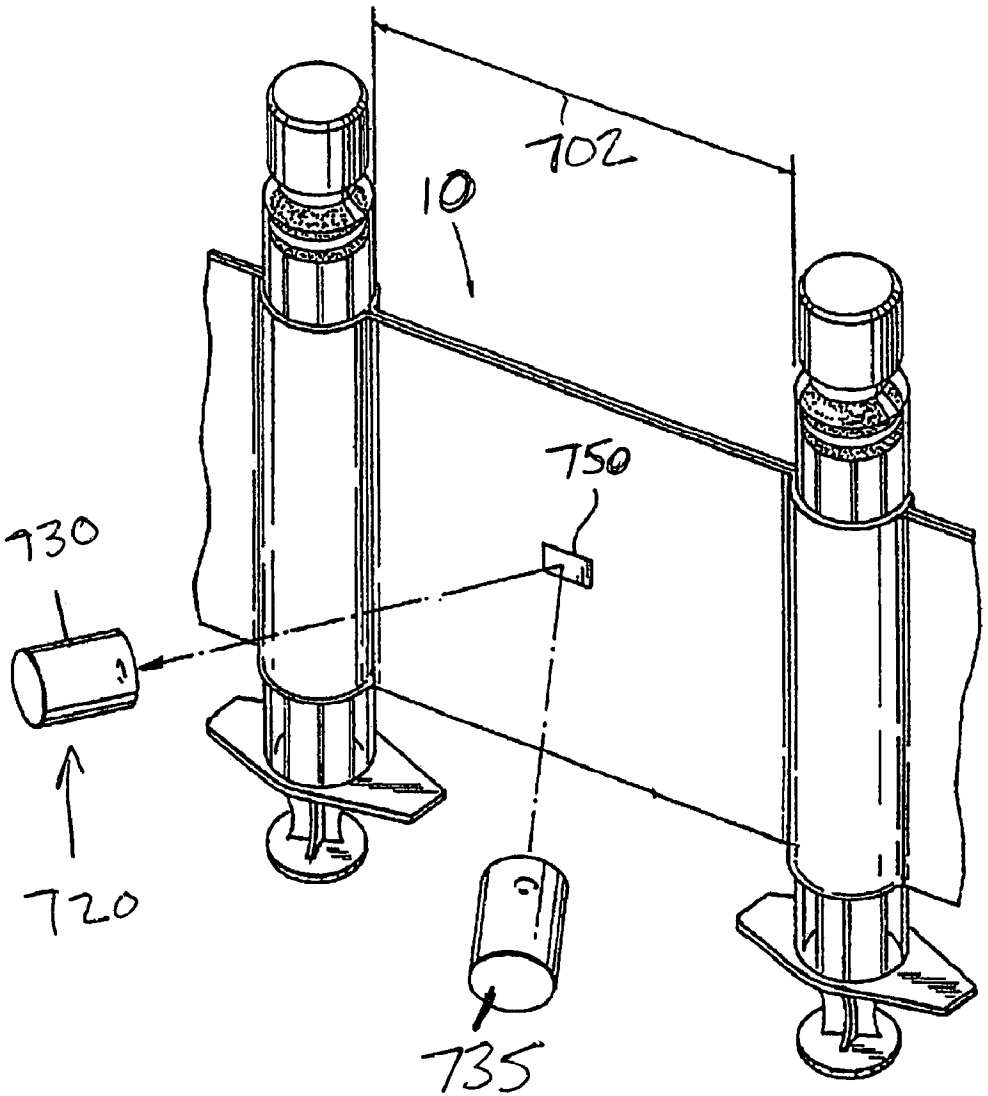
FIG. 17 is a side perspective view of a section of banded syringes with a control feature according to a second embodiment.

In another embodiment shown in FIG. 17, the control feature is in the form of an optical feature 750 that is used as part of an optical detection mechanism 720. As with the prior embodiment (FIG. 15), the optical feature 750 is formed in the prescribed region 702 of the banded syringes 10 with next adjacent optical features 750 being spaced a prescribed distance from one another.

Any conventional optical feature 750 that is suitable for use in the present application can be used. The detection mechanism 720 is a detection mechanism that optically detects the presence of the optical feature 750 when the optical feature 750 is in proper registration with an optical detector 730. For example, the optical detection mechanism 720 can include the optical detector 730 that faces the banded syringes 10 as the banded syringes are advanced. The optical detector 730 cooperates with a light source, such as a laser or LED 735 that also faces the banded structure 10 to detect the presence of the optical feature 750. Advantageously, the light source and optical detector are arranged relative to each other in accordance with Snell's Law of Reflection; however, the light source and detector can be arranged otherwise, such as normal to and facing the optical feature 750. The optical feature 750 can come in a number of different shapes and sizes.

The optical detection mechanism 720 operates essentially in the same manner as the detection mechanism 710 of FIG. 15. In other words, the banded syringes 10 are only advanced if the optical detection mechanism 720 reads the optical feature. If the banded structure 10 is advanced a prescribed distance and the optical detection mechanism 720 does not read the optical feature 750, the advancement of the banded structure 10 is stopped. Accordingly, proper registration between the optical features 750 and the detection mechanism 720 is needed for the banded structure 10 to be continuously advanced.

Figure 18:
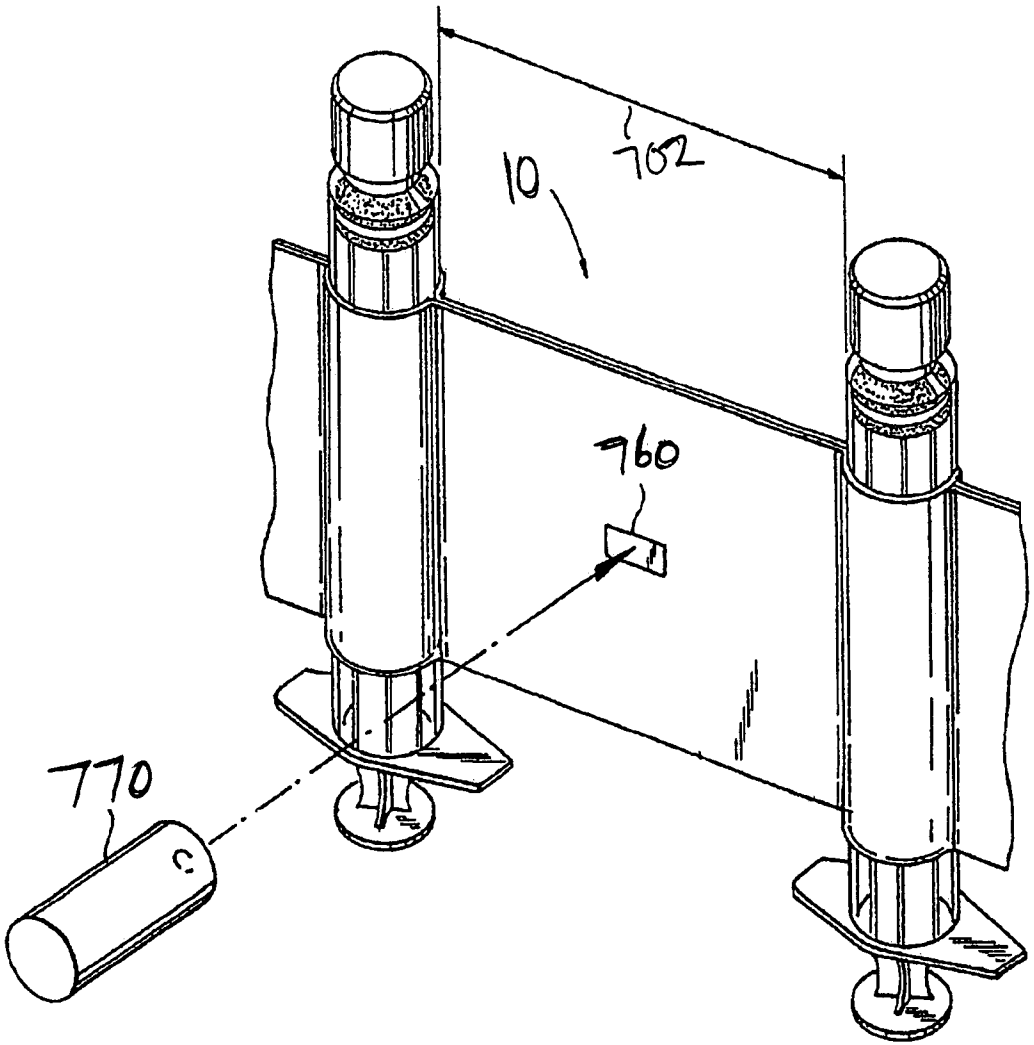
FIG. 18 is a side perspective view of a section of banded syringes with a control feature according to a third embodiment.

In yet another embodiment that is illustrated in FIG. 18, the control feature is a mark 760 that is formed within the prescribed interval 702 between spaced syringes and a detection mechanism 770 is used for detecting the mark 760. The mark 760 can be any number of types of marks, including a printed mark that is formed on the surface of banded syringes 10. As with the other embodiments, the detection mechanism 770 is used to detect the mark 760 and if a detection is not made within a prescribed time interval or during advancement of the banded structure 10 over a prescribed distance, the detection mechanism 770 signals a controller or the like to stop the advancement of the banded syringes 10.

It will also be appreciated that when the control feature is an aperture formed through the banded syringes 10 within the prescribed region 150, other types of detection mechanisms can be used rather than the pressure based detection mechanism discussed earlier. For example, the detection mechanism can be an ultrasonic system having an ultrasonic receiver and transducer. Ultrasonic waves are created one side of the banded syringes 10 and are emitted toward the banded syringes 10. When the control feature is in proper registration, the ultrasonic waves can pass through the aperture unimpeded and are detected on the other side of the banded syringes 10. When the detection mechanism is ultrasonically based, the system preferably includes an integrator and comparator so that ultrasonic waves that pass through the aperture can be differentiated from ultrasonic waves that reach the detector by means other than passing through the aperture (control feature).

Another type of detection mechanism that can be used with the banded syringes 10 is a thermal detection system. For example, the control feature 700 is still an aperture formed in the banded syringes 10; however, the detection mechanism is a thermal based system that includes a thermal source (e.g., heat lamp) and a thermal detector. The thermal source, such as a heat lamp, is disposed on one side of the banded syringes 10, while the thermal detector is disposed on the other side of the banded syringes 10. The thermal source and the thermal detector are positioned so that the aperture is in registration therewith at a point in time as the banded syringes 10 are advanced. The thermal detection mechanism is preferably coupled with an integrator and comparator. These two components permit the thermal detection mechanism to differentiate between heat that is detected across the aperture and heat that is detected through the banded structure 10 itself but outside of the aperture. Because heat that passes directly through the aperture is of higher intensity than heat that passes through the first and second layers of the banded syringes 10, the integrator/comparator can differentiate between the different thermal energies and only permit advancement of the banded syringes 10 when thermal energy passing through the aperture is detected.

Preferably, an ultrasonically, or heat or optically-based detection system includes logic such that the system does not merely detect ultrasonic waves, optical waves or heat waves but also analyzes the character, e.g., amplitude, of the waves. The detection system can therefore be configured to effectively filter out waves that do not meet certain criteria. The criteria is preferably a threshold that is achieved only when waves pass directly through the aperture (control feature) and are detected by the detection mechanism on the other side of the banded syringes 10. Thus, waves that do not pass through the aperture but are otherwise detected on the other side of banded structure 10 do not register as a detection since they lack the prescribed criteria.

The control feature can comprise a segment of web material that permits passage of heat or light (of a given frequency, for example) while the remainder of the strip is treated (e.g., coated) to block heat or light of prescribed frequencies. Thus, it can be appreciated that the control feature can take on a variety of forms to ensure proper handling of the bandolier type syringes.

Referring to FIGS. 1–16, in which a syringe bandoliering station 100 is illustrated in greater detail. As best shown in the perspective view of FIG. 1, the station 100 includes an automated system 110 for receiving, orientating, and banding a plurality of syringes 10 together in a predetermined arrangement so that the syringes 10 can be stored in an interconnected manner or can be transported to another location, such as a first station 1020 (FIG. 16) where the syringes 10 are further processed and introduced into an automated syringe preparation system. Thus, the syringes 10 can be banded at one location and then transported to another location where the syringes 10 receive medication and are ready for use and more particularly, the banded syringes 10 can be delivered to the automated system 1000 of FIG. 16; or the banded syringes 10 can be packaged in an empty condition for later processing and use.

The exemplary system 110 is defined by a number of stations where one or more specific operation is performed at each station as the syringes 10 are received and then manipulated so that a syringe bandolier is formed. For example, the system 110 includes a syringe feed station 120 where loose syringes are initially fed; a first transport station 140 that receives syringes 10 from the feed station 120 after the syringes 10 have been orientated in a desired way and then delivers them to an index station 160; a second transport station 180 receives the syringes 10 from the index station 160 and then delivers the syringes 10 in an ordered fashion to a web application station 200, where a web material is applied to the syringes 10 to form the banded syringe structure. The banded syringe structure (syringe bandolier) is then transported to another location where it is further processed.

The syringe feed station 120 is generally a station where a number of loose syringes 10 are fed into a syringe feeder device 122. The syringes 10 can be fed into the syringe feeder device 122 without worrying about their orientation and therefore, a number of syringes 10 can be dumped into a receiving section of the syringe feeder device 122 so long as the feeder device 122 is not overfilled. The syringe feeder device 122 is of the type that receives a number of items or parts (e.g., syringes 10) and then through operation thereof arranges the items in a desired orientation so that the items can be fed to the next station at a controlled rate and in the desired orientation.

One exemplary syringe feeder device 122 is a centrifugal bowl feeder that is configured to feed the syringes 10 at a controlled rate and in a desired orientation to the next station. Conventional centrifugal bowl feeders can be used in the present system and each includes an opening or the like that receives items in a bulk state and forms an entrance to a bowl surface (central reservoir) 124 that receives the items in a random orientation. Typically, the bowl surface 124 has a generally conical shape; however, the precise shape and construction of the centrifugal bowl feeder is not critical so long as it can perform its intended function. The centrifugal bowl feeder is designed to propel the syringes 10 around the outer peripheral edge of the bowl feeder by means of centrifugal force. The centrifugal bowl feeder 122 includes a feed track 126 formed-on the outer peripheral edge thereof and includes tooling for orientating and segregating the syringes 10 prior to delivering the syringes 10 to the next station. In other words, through centrifugal force generated by movement of the bowl feeder 122 and the design of the orientation tooling, the syringes 10 are orientated in a desired manner as they advance along the feed track 126. There are also features that are formed as part of the feed track to cause misorientated items to fall back into the reservoir so that these items can then be reorientated.

Figure 1:
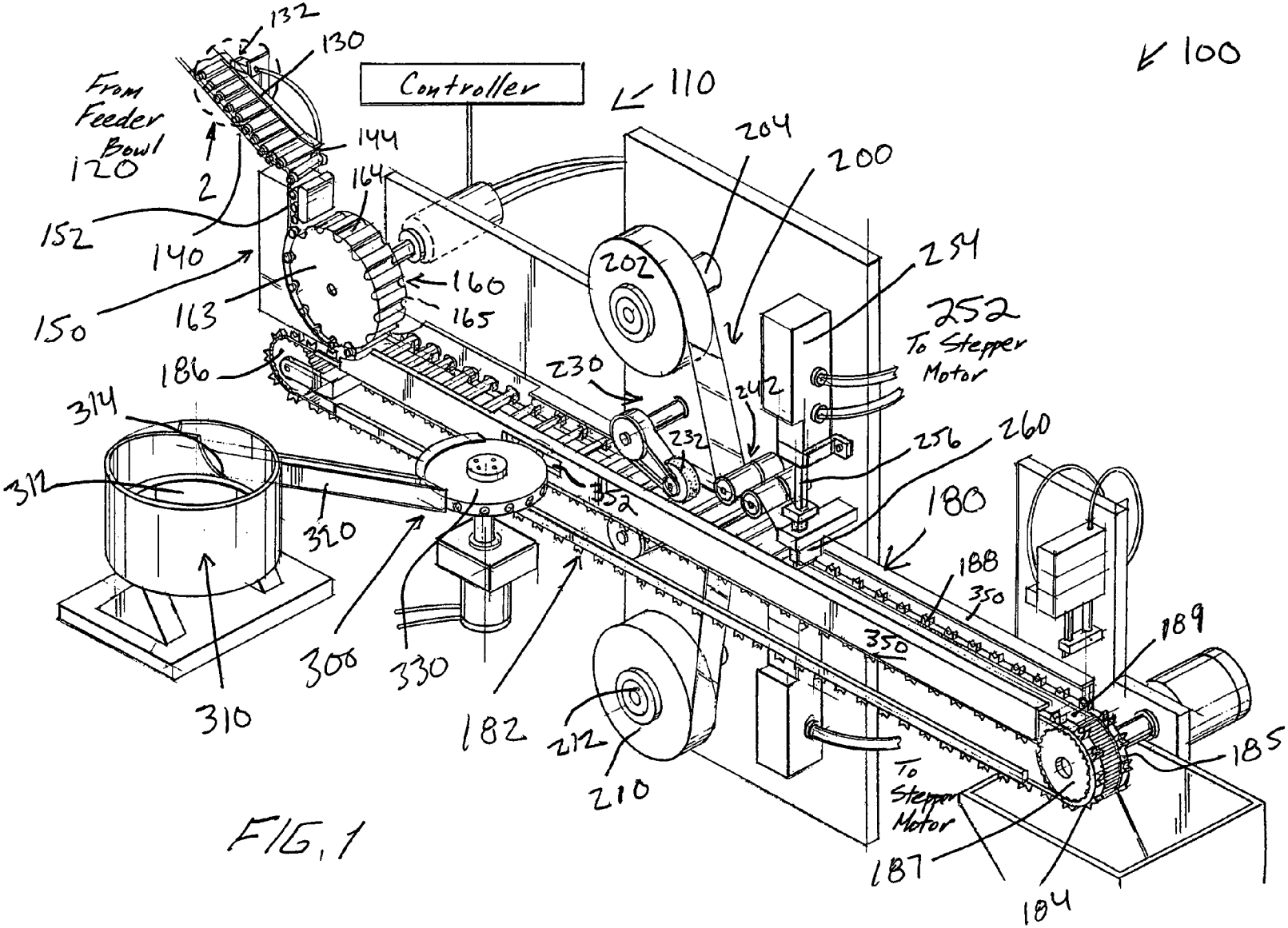
FIG. 1 is a perspective view of an automated system for handling a plurality of syringes using a bandoliering operation to form a banded syringe structure.
Figure 1A:
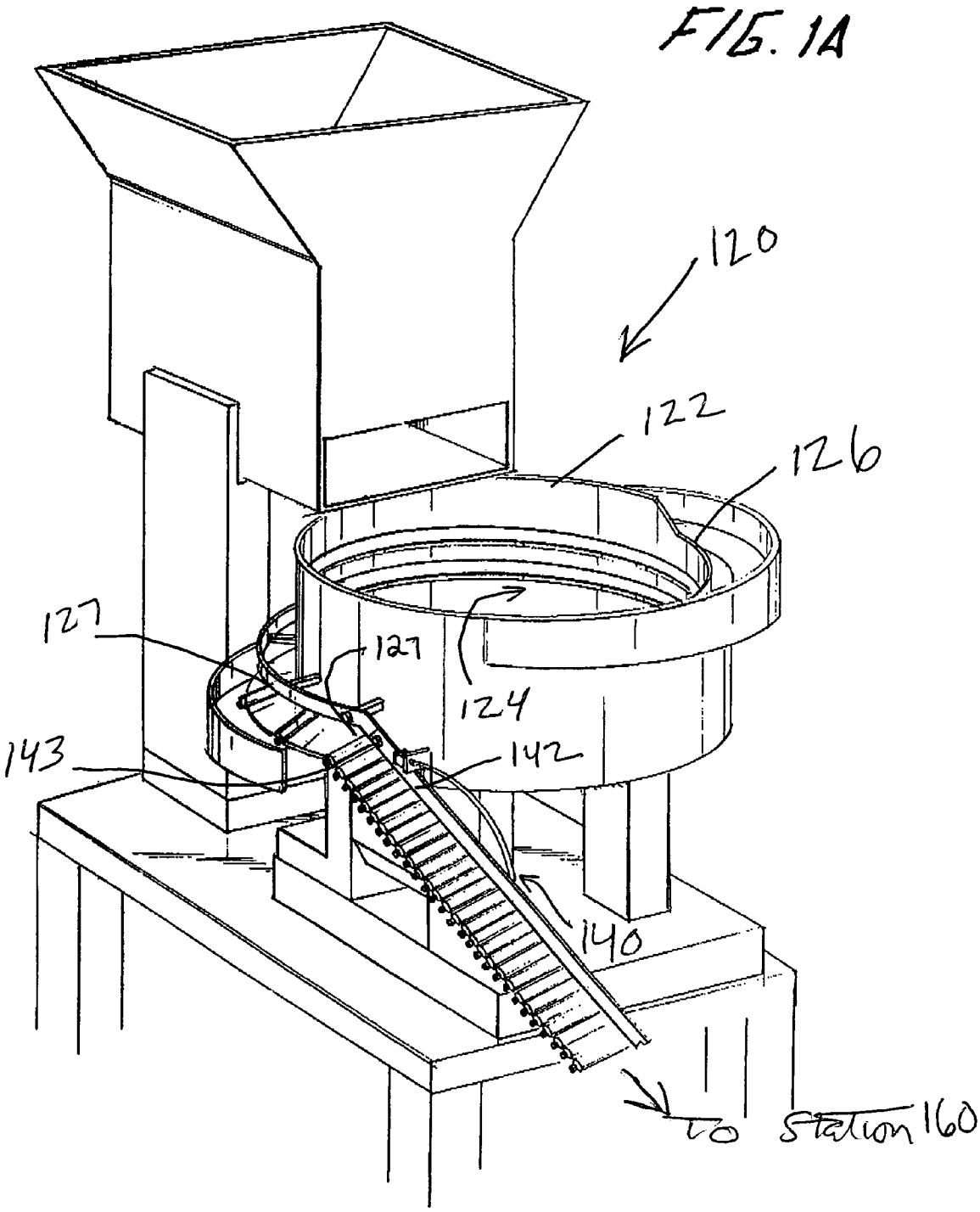
FIG. 1A is a perspective view of a feed device for introducing loose syringes into the system according to a predetermined arrangement.
Figure 2:
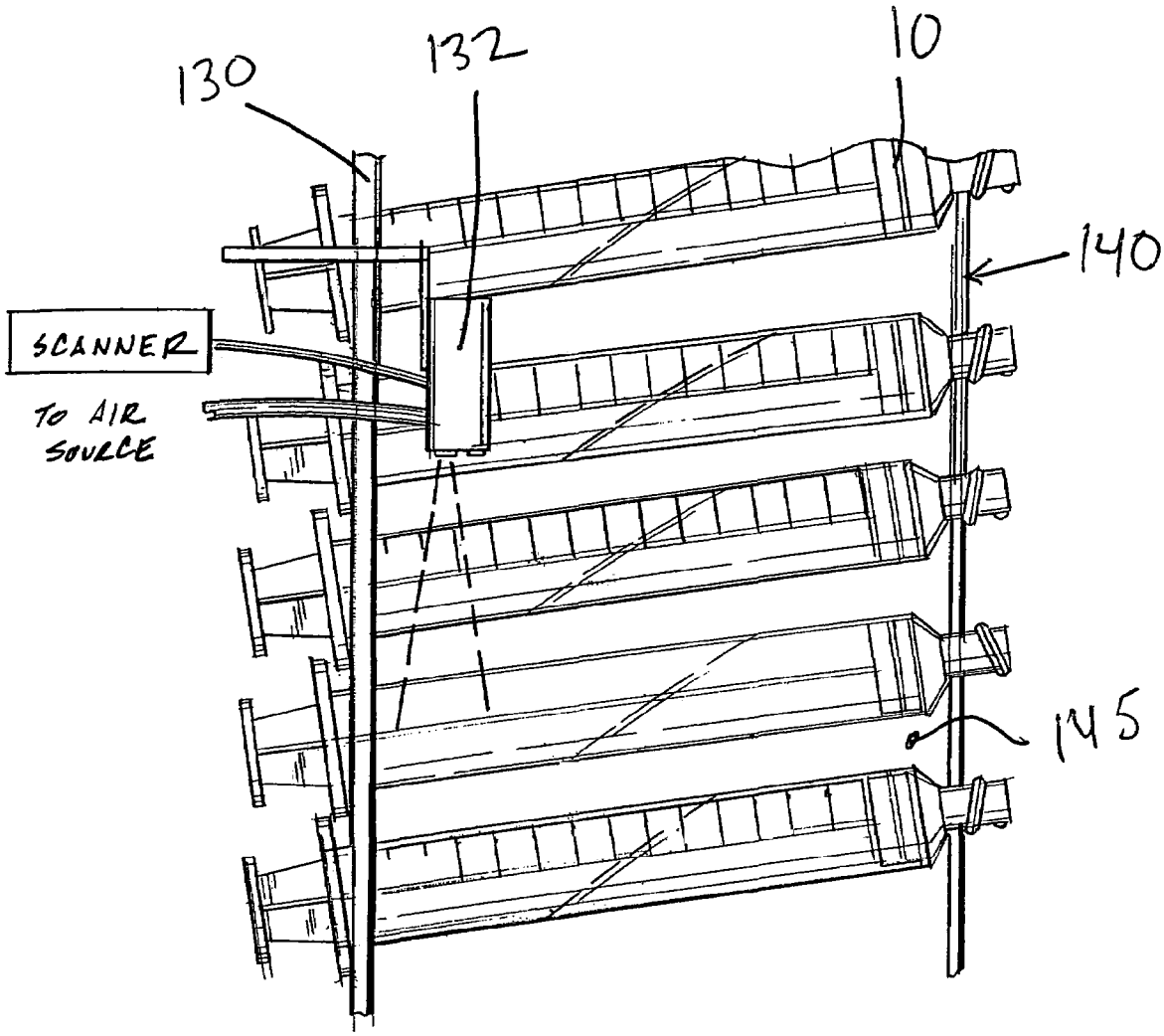
FIG. 2 is an enlarged top plan view of a feeder rail and detector mechanism that is part of a feed mechanism of FIG. 1.
Figure 3:
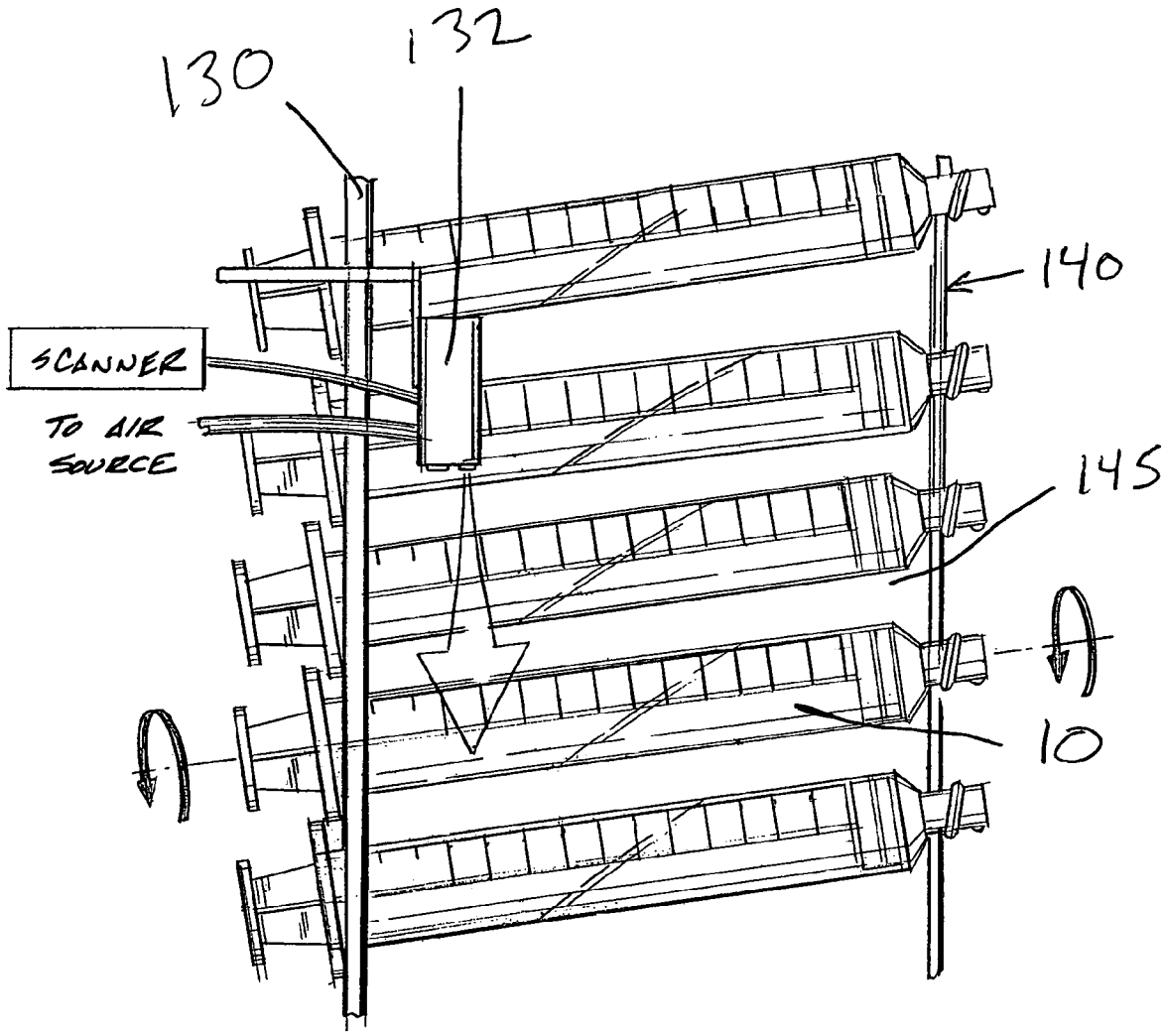
FIG. 3 is an enlarged top plan view of the feeder rail and detector mechanism of FIG. 2 showing action of a syringe repositioning device.

The exemplary feed track 126 of the syringe feeder device 122 illustrated in FIGS. 1 and 2 is in the form of a guide rail that is disposed around the peripheral outer wall of the bowl and the feed track 126 is not orientated in a planar manner but rather it rises along the peripheral outer wall to an exit mechanism 127 that causes the syringes 10 to exit the feeder device 122 in the preferred orientation (e.g., horizontal with the plungers being aligned and located next to one another). In the exemplary cylindrical feeder device 122, the feed track 126 has a spiral orientation.

Because of its bowl-like configuration, the syringe feeder device 122 has a generally annular shape and includes a feeder discharge (exit port) formed as part of the exit mechanism 127 along an outer periphery thereof to permit the syringes 10 to exit the reservoir once the syringes 10 have been arranged in the desired orientation by the orientation tooling. As just mentioned, the syringes should exit the syringe feeder device 122 in a horizontal orientation (e.g., the syringes lay across a floor of the exist mechanism) and in fact, as the syringes exit, the plunger flange and the barrel flange that lies near the plunger flange are disposed on one side of a rail 130 so as to locate and restrict the free movement of the syringes as they are fed out of the syringe feeder device 122. For example, the rail 130 prevents lateral movement of the syringes since if the syringes were moves laterally, the barrel flange would strike the rail 130 and thereby prevent any additional lateral movement.

The exit mechanism 127 includes a sensor device and syringe repositioning device 132 to ensure that the syringes 10 are discharged from the feed track 126 such that the syringes 10 are delivered to the first transport station 140 in an orderly manner and in the desired orientation. For example, while the tooling of the syringe feeder device 122 ensures that all of the syringes 10 exit the device with a horizontal orientation and with all of the plungers aligned and orientated at one end, it is desirable for all of the syringes 10 to have a common face facing up or down. More specifically, one face of the syringe 10 typically includes markings, such as gradations, and it is desirable for the syringes 10 to be banded in a common orientation such that the markings (gradations) are all facing the same direction. This not only provides uniformity in the bandoliering process as well as creates a more visually pleasing product but also permits the user to easily view the banded syringes to check and confirm valuable information, such as the volume amount, etc.

One exemplary sensor device and syringe repositioning device 132 is a device that can determine whether the markings of the syringe 10 are in the proper orientation (face up or face down) and can take the necessary remedial action for correcting the orientation of any syringe 10 that is found not be in the correct orientation. For example, the device 132 can be in the form of an optical sensor device that optically scans and reads the face of the syringe 10 as it passes nearby and is capable of detecting whether the marking (gradations) are facing up or not relative to the optical sensor device. The syringes 10 are permitted some degree of rotation on the first transport station 140 and therefore, the syringes 10 can either be in-phase (markings in correct position) or out-of-phase (markings from in-phase position). In one embodiment, the sensor part of the device 132 constitutes an optical eye (optical sensor) that is capable of reading the body of the syringe 10 to detect the presence or absence of the markings (gradations). Typically, this detection is done using standard optical recognition software where an image of the target syringe is compared with images stored in a database, whereby the sensor is able to detect whether markings are facing upright towards the sensor. More specifically, the optical eye has a range of detection (measured in degrees) whereby it is capable of detecting any object that falls within that range of detection. For example, the optical eye can have a range of detection of 45 degrees and therefore if an object (such as markings) lie within the 45 degree window, it is treated as being in-phase.

In the event that the device 132 detects that the markings are not facing upright (e.g., lie outside of the range of detection), the device 132 takes the necessary remedial actions to reposition the target syringe 10 so that the markings face upright. The device 132 thus contains a mechanism that can accomplish this action of repositioning the syringe. According to one embodiment, this mechanism is in the form of a mechanism that directs a prescribed amount of fluid toward the syringes 10 to cause rotation of the syringe such that the markings (gradations) that were outside of the range of detection are now facing upright towards the sensor in the desired orientation (in the range of detection) (see FIGS. 2–3). Since an out-of-phase syringe 10 can be any number of degrees out-of-phase, the amount of fluid that is directed towards the syringe 10 will vary from application to application. In one embodiment, the mechanism is constructed such that a predetermined quantity (volume) of fluid is discharged toward the syringe so as to cause rotation of the syringe. If after this first discharge of fluid, the markings are still not in-phase (within the range of detection of the optical eye), the mechanism will discharge another dose of fluid (same predetermined volume as first discharge) so as to cause further rotation of the syringe. Once again, the optical eye senses whether the syringe markings have rotated into the range of detection of the optical eye and if the markings are detected as having rotated within this detection window, then the device 132 detects that the markings (gradients) are now in the correct orientation (in-phase) and the syringe 10 continues to advance downstream of the device 132 and transition from the feeder device 122 to the first transport station 140. If the syringes 10 are properly orientated (in-phase) from the beginning, the sensor 132 detects this and the repositioning mechanism thereof is not activated and as a result, the syringes 10 continue to advance along the feed track 313 toward the entrance to the first transport station 140.

Preferably, the device 132 is located at an interface between the feeder device 122, more particularly, the exit mechanism 127 thereof, and the first transport station 140. It will be appreciated that the rail 130 extends both upstream and downstream of the sensor and repositioning device 132 such that the syringes 10 are contained and remain in desired orientations as they exit the feed track 126 and enter and travel along the first transport station 140.

As illustrated in FIGS. 1–5, after the device 132 acts to properly orientate the syringes 10, the syringes 10 are delivered from the syringe feeder device 122 to the first transport station 140 that delivers the syringes to another downstream station. The first transport station 140 includes a first transport mechanism 142 that has a first end 143 that is operatively connected to the syringe feeder device 122 and a second end 144 that is operatively connected to the index station 160.

Any number of different first transport mechanisms 142 can be used so long as the mechanism is designed to receive the syringes 10 in the desired orientation and segregated manner and then deliver the syringes 10 to the next downstream station. One exemplary first transport mechanism 142 is a feeder rail that has a drive feature for assisting in advancing the syringes 10 from the first end 143 to the second end 144, while maintaining the syringes 10 in their desired orientation. The feeder rail 142 can be an in-line track that with a straight line drive unit that is designed to produce linear vibratory motion that acts to covey parts horizontally from the feeder discharge located at or proximate the first end 143 to the second end 144 where the syringes 10 are then delivered to another station. The feeder rail 142 accepts only syringes that are properly positioned (e.g., horizontally lying syringes 10 with plungers arranged on one side).

For example, one exemplary feeder rail 142 has a declined ramp in the form of a floor 145 on which the syringes 10 sit as they move from the first end 143 to the second end 144. The floor 145 has a smooth surface to permit the syringes 10 to slide therealong as they are advanced therealong. The floor 145 is operatively connected to the drive source such that the vibratory drive action of the drive source is translated thereto. The feeder rail 142 also includes the guide rail 130 which is likewise a part of the feeder device 122 and continues therefrom. As previously mentioned, the guide rail 130 serves to maintain the syringes 10 in desired orientations since it prevents extensive latitudinal movement of the syringes 10 on the floor 145 as the syringes 10 move from the end 142 to the end 144. Since the floor 145 is declined (ramped down), the syringes 10 will slide under gravity down the feeder rail 142 towards the second end 144. The guide rail 130 prevents any unnecessary movement of the syringes 10 since it 144 the syringes 10 down the ramp by having the barrel flange being located on the outside of the guide rail 130. Thus, all of the syringes 10 are located so that the plungers are disposed on the outside 130 the guide rail 130 and the syringes 10 are uniformly transported in that they are each orientated so that the syringe plunger is on the outside of the guide rail 130.

The syringes 10 are loaded onto the floor 145 adjacent one another and are even permitted to contact one another as they slide down over the floor 145 from the end 143 to the end 144. Since the device 132 has orientated the markings in a uniform manner and the barrel flange prevents rotation of the syringes on a flat surface, such as the floor 145, it is ensured that the syringes 10 will be in the same orientation at the second end 144 as they were at the first end 143.

Thus, the linear vibratory motion that is imparted to the feeder rail 142 causes the hanging syringes 10 to advance the length of the feeder rail floor 145 from the first end 143 to the second end 144. The syringes 10 are advanced sequentially (in-line) along the feeder rail 142 one after another as a result of the vibratory motion which in effect causes the syringes 10 to push each other forward from the first end 143 to the second end 144.

Figure 4:
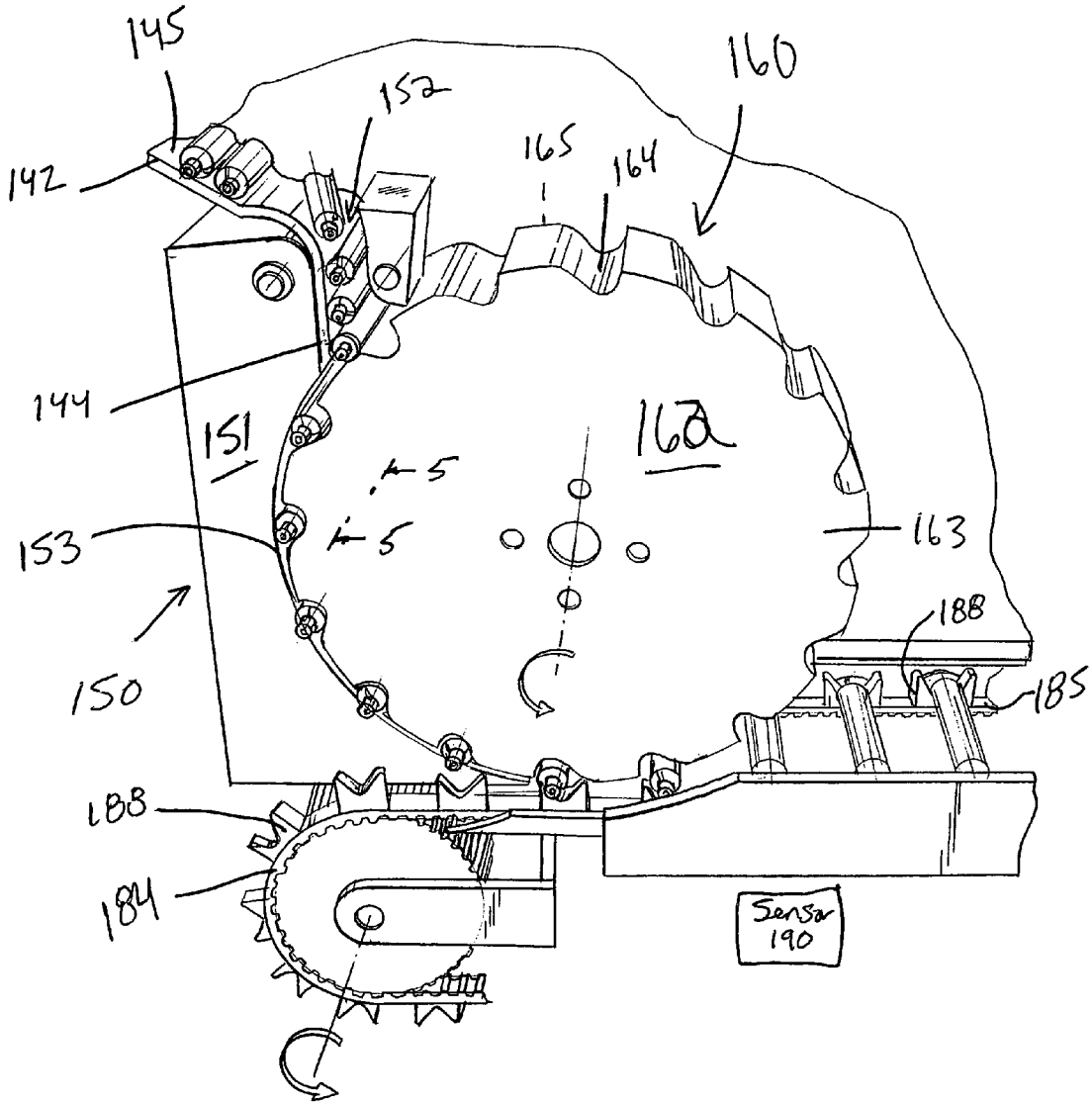
FIG. 4 is a perspective view of the interaction between the feed mechanism and a rotary dial for advancing the syringes onto a transportation mechanism that advances the syringes to a web application station.

The first transport station 140 preferably includes a mechanism 150 (FIGS. 1, 4 and 5) for properly positioning the syringe 10 into a guide receiving feature formed as part of the index station 160. Referring to FIGS. 1 and 4, the index station 160 includes a rotary dial 162 that has a number of guide receiving grooves 164 that are formed radially around the outer periphery of the rotary dial 162. More specifically, the rotary dial 162 has a first face 163 and an opposing second face 165 with the grooves 164 extending on the outer peripheral edge from the first face 163 to the second face 165. The rotary dial 162 is mounted so that the grooves 164 are substantially perpendicular to a longitudinal axis of the floor 145 that extends from end 143 to end 144. The rotary dial 162 is also mounted so that it is below the end 144, thereby permitting the syringes 10 to be gravity fed into the rotary dial 162 by way of the mechanism 150.

Each groove 164 has a shape that is complementary to the shape of the syringe barrel so that the syringe barrel nests within the groove 164 when it is directed therein. Further details and the operation of the rotary dial 162 are described below. As shown in FIG. 4, preferably, the groove 164 is a contoured groove that has a flared leading edge to facilitate receiving and discharging the syringe 10.

One exemplary mechanism 150 is a guide block that includes an opening or feed channel 152 for receiving and guiding syringes 10 from the end 144 of the floor 145 to the rotary device 162 and more specifically into one of the grooves 164. The channel 152 is thus aligned with the circumferential edge of the rotary dial 162 that includes the grooves 164 and it will be appreciated that the syringes 10 are delivered to the channel 152 and then are gravity fed through the channel towards the rotary dial 162. Thus, at any one point in time, it is likely that more than one syringe 10 will be disposed within the channel 152 and they will merely be in a stacked relationship. The next syringe 10 to be fed (the lowermost syringe in the stack) slides down the channel 152 and seats against the circumferential edge of the rotary dial 162. Since the grooves 164 act as nesting grooves and the surfaces of the circumferential edge between the grooves 164 act as blocking surfaces since the next-in-line syringe 10 will only drop into and become nested within the groove 164 when the groove 164 is in registration with the channel through which the syringe 10 is fed. As soon as this registration results, the syringe 10 will drop into the groove 164 and become nested therein and then under action of the rotary device 160, the nested syringe 10 will be moved. When the groove 164 is not in registration with the channel 152, the syringe 10 will merely seat against the surface of the circumferential edge between two adjacent grooves 164 until the rotary device 160 rotates and the groove 164 becomes in registration with the channel, thereby permitting the syringe 10 to fall into the 164.

Figure 5:
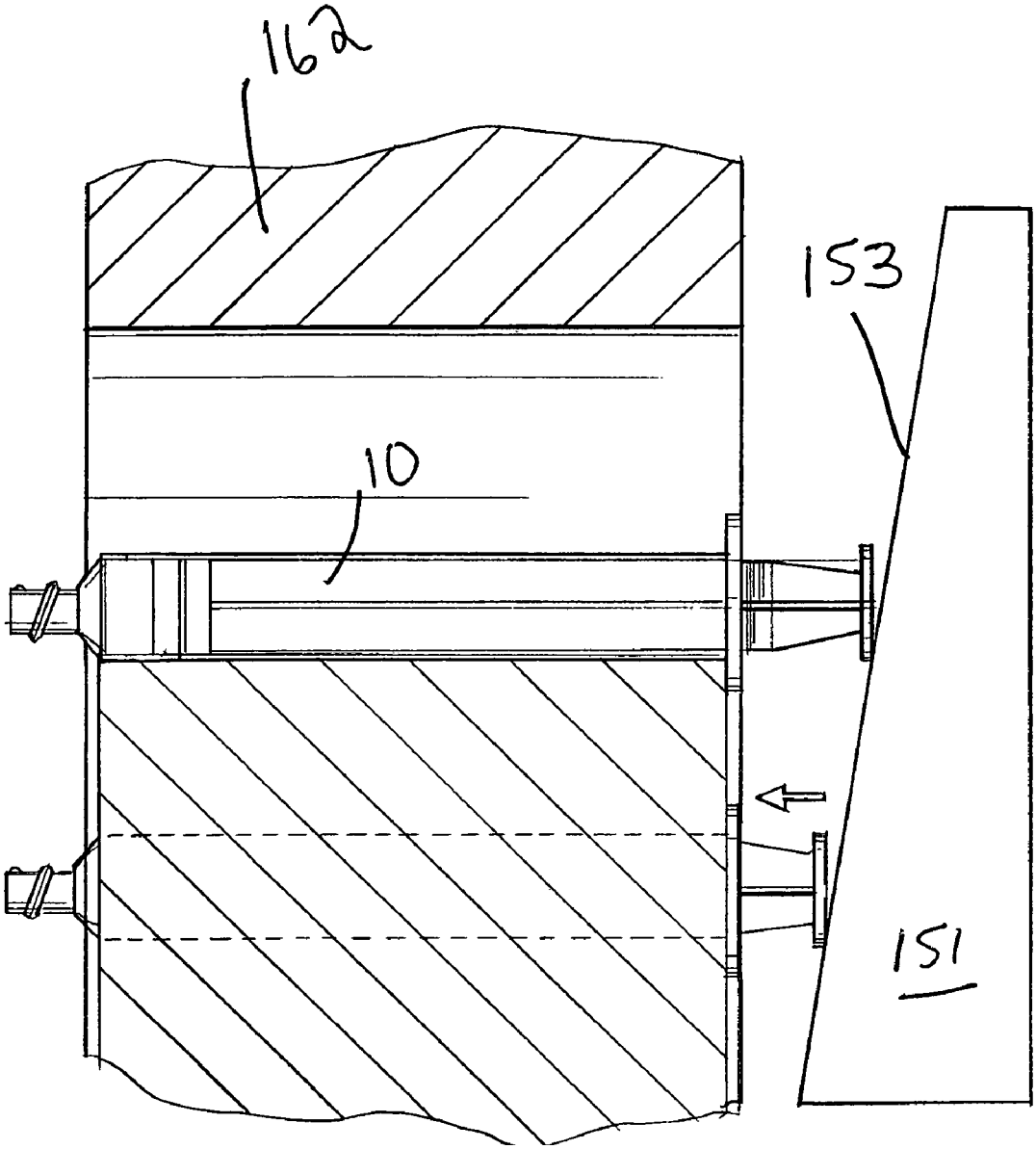
FIG. 5 is a cross-sectional view taken along the line 5—5 of FIG. 4.

The mechanism 150 is defined by a body 151 though which the channel 152 is formed and the body 151 also includes a cam surface 153 that serves to uniformly place the plunger of the syringe 10 in the retracted position in case the plunger is fed into the rotary dial 162 in a position where it is at least partially extended. More specifically, the cam surface 153 is a smooth curved section that has a cam surface formed as a part thereof and is located downstream of the channel 152 such that after the syringes 10 are nested in grooves 164, the rotary device 162 rotates counterclockwise, thereby brining each syringe 10 into contact with the cam surface 153. At the beginning of the body 151 where the syringe 10 initially is brought into contact, the cam surface 153 is at its greatest dimensions so as to permit the ends of the syringe 10 to fit between end portions of the cam surface 153 without the cam surface 153 obstructing or applying any force against the plunger or other end of the syringe 10. In other words, the syringe 10 is fed between the ends of the cam surface 153 and as the rotary device 160 rotates, the ends of the syringe 10 optionally engage and contact the ends of the cam surface 153. The cam surface 153 is contoured such that the surface progressively is directed toward the rotary dial 162 and therefore, as the rotary dial 162 rotates, the cam surface continuously and progressively engages the plunger and directs it inwardly such that the plunger is fully retracted as shown in FIG. 5. It will be appreciated that the end of the syringe 10 opposite the plunger is prevented from moving laterally in the same direction as the direction that the force is applied to the plunger since this end of the syringe 10 must be kept in place in order for the plunger to be retracted. The syringes 10 can be held in place, even when the cam surface 153 applies a force thereto, by being pinched between the rotary dial body and the body 151, including the cam surface 153 thereof. In other words, as the syringe 10 is rotated within the groove 164, any open plunger will at some point contact the cam surface 153 depending upon the initial distance that the plunger is extended and then continued driving of the syringe 10 against the cam surface 10 results in the plunger being retracted. In this manner, uniformity is created in the syringes for loading downstream since it is ensured that all of the plungers will be in the retracted position and thus, the syringes can be banded with all the syringes being in the same condition.

It will be understood that as the rotary dial 162 rotates, the syringes 10 are held in place within the grooves 164 by means of being pinched between rotary dial body and the cam surface of the body 151 so to speak and therefore, even when the rotary dial 162 is in a position between 9 and 6 o'clock, the syringes 10 will not fall out of their nesting positions within the grooves 164. As described below, the cam surface 153 terminates at a position that corresponds to a location where the syringe 10 exits the rotary dial 162 and is transferred to the next station.

The second transport station 180 acts to receive the syringes 10 from the rotary dial 162 and then advances the syringes 10 to the tape application station 200, while maintaining a predetermined distance between adjacent syringes 10. In one exemplary embodiment, the second transport station 180 includes a conveyor or drive belt 182 for transporting the syringes 10 along a linear horizontal path to the downstream tape application station 200. The conveyor 182 is actually formed of two spaced endless belts 184, 185 that are disposed around and driven by two drive rollers 186, 187 that are spaced apart a predetermined distance. As is known, each endless belt 184, 185 is fitted around the drive rollers 186, 187 so that a first section of the endless belt acts as an upper surface that faces the rotary dial 162 and a second section of the endless belt acts as a bottom surface that faces an opposite direction. The conveyor 182, its components, and its operation are conventional and therefore are not described in great detail. For example, the drive rollers 186, 187 preferably are in the form of wheels, where at least one of the wheels is operatively coupled to a respective drive shaft (partially shown) which in turn is operatively connected to a motor or other type of drive unit that permits the controlled advancement of the endless belts 184, 185. The drive rollers 186, 187 can include features formed as a part thereof for securely engaging the endless belts 184, 185 so that it can be advanced without slippage. The endless belt 184 is disposed at or near one edge of the rollers 186, 187, while the other endless belt 185 is disposed at or near another, opposite edge of the rollers 186, 187 with a space 189 being defined between the endless belts 184, 185.

As shown in the illustrated embodiment, the endless belts 184, 185 have a plurality of syringe locating and retaining members 188 that are formed as part thereof and are spaced along the endless belts 184, 185. These members 188 are spaced at a predetermined distance from one another so that the syringes 10 are spaced a predetermined, desired distance from each other. In other words, the distance between any two members 188 is the same to ensure that the distance between adjacent syringes 10 is the same. The distance between the grooves 164 of the rotary dial 162 is thus equal to or substantially equal to the distance between the members 188.

According to one exemplary embodiment, the members 188 are a pair of fingers that are that spaced apart from one another and are constructed to receive one syringe 10 in a nested manner. More specifically, the endless belt 184 has a plurality of spaced members 188 and the endless belt 185 has a plurality of spaced members 188 that are arranged so that the members 188 on the two belts 184, 185 are arranged in pairs. In other words, the pairs of members 188 are axially aligned with respect to one another so that one member 188 of the pair receives the syringe barrel 20 at a location proximate the tip cap 40 and the other member 188 receives the syringe barrel 20 at a location proximate the barrel syringe.

Each finger that forms a part of the member 188 is formed of two vertical walls that are spaced apart from one another and are preferably slightly angled relative to one another so that the two vertical walls have a generally V-shape, with the distance between the open tops of the vertical walls being greater than a distance between the lower sections of the vertical walls. Alternatively, each member 188 can be a single integral member that has a contoured groove formed therein to receive the syringe 10 in a nested manner. The fingers are therefore configured to cradle the syringe barrel 20 after it is received from the rotary dial 162. When the syringe 10 is inserted into the fingers, the barrel flange extends beyond the pair of fingers and seats approximately thereagainst. The center region between the two fingers corresponds generally to where the center of the barrel flange should rest and therefore the distance between the center regions of the two fingers is preferably equal to the distance between the centers of adjacent syringes 10.

The rotary dial 162 is positioned relative to the belts 184, 185 and more particularly, relative to the members 188, such that as the rotary dial 162 advances with the syringes 10 captured therein, the syringes 10 are sequentially introduced into open pockets formed by the members 188. The syringe body 20 is thus fed into the pocket (between the fingers) from above as the rotary dial 162 rotates since at the point of syringe transfer (6 o'clock or so position). If registration between an empty pocket and the next-in-line syringe does not exist, then the syringe is prevented from engaging the second transport station 180 due to contact with the tops of one of the fingers 188 and as soon as the empty space between the members 188 comes into registration with the syringe, it falls therein to become nested therein.

However, preferably, the movements of the rotary dial 162 and the belts 184, 185 are coordinated, the members 188 are properly positioned relative to at least one of the grooves 164 of the rotary dial 162 to receive one syringe 10. Because the belts 184, 185 are driven by the same drive unit, the belts 184, 185 are driven at the same speed and therefore, the opposing pairs of members 188 remain in alignment and do not become misaligned relative to one another when the belts 184, 185 are advanced.

As previously mentioned, the rotary dial 162 is part of a programmable system such that the dial 162 and the belts 184, 185 can be coordinated with respect to one another.

The system 100 also optionally includes a sensor device 190 for detecting the presence of a syringe 10 relative to a receiving pair of fingers 188. The sensor device 190 is in communication with a controller and is configured to send a signal to the controller when the syringe 10 is in its proper orientation proximate the pair of receiving fingers 188. The proper orientation of the syringe 10 will vary depending upon the construction and placement and orientation of the vacuum dial 162 relative to the second transport device 180; however, it is generally a position where the syringe 10 lies above the pair of fingers 188 so that when the vacuum source is deactivated, the syringe 10 is already within the boundaries of the fingers 348 and it falls only a small distance within the fingers 188 to its resting position. For example, one exemplary sensor device 190 (FIG. 4) is mounted as part of the second transport device 180 and is of the type that emits a beam such that when the syringe 10 impinges the beam due to it being brought into position within the fingers 188, the sensor device 190 sends a signal to the controller indicating the detection of the syringe 10 in the pocket defined by the pair of fingers 188.

One exemplary sensor device 190 is disposed along at least one of the belts 184, 185 and is configured to emit a light beam or the like. The sensor device 190 is preferably located between one of the pairs of fingers 188 such that normal advancement of the dial 162 causes one of the syringes 10 to be introduced into the pocket defined by the pair of fingers 188 and impinge or break the light beam. As soon as the syringe 10 breaks the light beam, the sensor device 190 sends a control signal to the controller instructing that the syringe is in position for transfer to a pocket between the members 188. The dial 162 is then preferably advanced to the next index position and the process is repeated.

The controller can be configured so that when the dial 162 is advanced after one syringe 10 has been deposited into one respective pocket (defined by the pair of fingers 188) and the now empty groove 164 is thus ready to receive another syringe 10 when it is advanced to a receiving position adjacent the first transport device 140.

While the exemplary sensor device 190 is one which emits a beam or the like (e.g., infrared beam), it will be appreciated that any number of other types of sensor devices 190 can be used so long as the sensor device 190 can detect the presence of the syringe 10 within the pocket. A preferred mounting location for the sensor device 190 is along one of the belts 184, 185 at a location between adjacent fingers 188 that form one member that receives the syringe 10. In the exemplary arrangement, the syringe 10 is deposited from the dial 162 to the pocket defined by the fingers 188 when the syringe 10 is advanced to the 6 o'clock index position on the dial 162, while the fingers 188 are in a 12 o'clock position relative to the drive roller 186. Once the syringe 10 is disposed within and securely held by the opposite pairs of fingers 188, the second transport device 180 advances the syringe 10 from the index station 160 to the web application station 200 by means of the movement of the belts 184, 185.

In accordance with one embodiment of the present invention, another station that is optionally but preferably included is a cap placement station 300 in which one cap 40 is placed on a corresponding empty barrel tip of the syringe 10 as best shown in FIGS. 1 and 6–9. In one mode of operation, the system 100 is operated by initially feeding syringes 10 that do not have any caps attached to the barrel tips of the syringes 10. There are a number of different reasons as to why syringes without caps can be used in the present invention. One reason is cost in that it is less costly to initially purchase bulk quantities of syringes 10 without caps placed thereon and then the user subsequently places caps on the syringes prior to the capped syringes being delivered to the web application station 200.

The cap placement station 300 is an automated system that can be operatively connected to the programmable system so that the cap placement station 300 and the other automated stations, including the transport systems, etc., can be coordinated with one another so that the two operate in unison.

The cap placement station 300 is generally a station where a number of loose cap 40 are fed into a cap feeder device 310. The caps 40 can be fed into the cap feeder device 310 without worrying about their orientation and therefore, a number of cap 40 can be dumped into a receiving section of the cap feeder device 310 so long as the feeder device 122 is not overfilled. The cap feeder device 310 is of the type that receives a number of items or parts (e.g., caps 40) and then through operation thereof arranges the items in a desired orientation so that the items can be fed to the next station at a controlled rate and in the desired orientation.

One exemplary cap feeder device 310 is a centrifugal bowl feeder that is configured to feed the caps 40 at a controlled rate and in a desired orientation to the next station. Conventional centrifugal bowl feeders can be used in the present system and each includes an opening or the like that receives items in a bulk state and forms an entrance to a bowl surface (central reservoir) 312 that receives the items in a random orientation. Typically, the bowl surface 312 has a generally conical shape; however, the precise shape and construction of the centrifugal bowl feeder is not critical so long as it can perform its intended function. The centrifugal bowl feeder 310 is designed to propel the caps 40 around the outer peripheral edge of the bowl feeder by means of centrifugal force. The centrifugal bowl feeder 312 includes a feed track 314 formed on the outer peripheral edge thereof and includes tooling for orientating and segregating the caps 40 prior to delivering the caps 40 to the next station. In other words, through centrifugal force generated by movement of the bowl feeder 310 and the design of the orientation tooling, the caps 40 are orientated in a desired manner as they advance along the feed track 314. There are also features that are formed as part of the feed track to cause misorientated items to fall back into the reservoir so that these items can then be reorientated.

One exemplary feed track 314 of the cap feeder device 310 is in the form of a guide rail that is disposed around the peripheral outer wall of the bowl and the feed track 314 is not orientated in a planar manner but rather it rises along the peripheral outer wall to an exit mechanism 316 that causes the caps 40 to exit the feeder device 310 in the preferred orientation (e.g., top base portion all aligned with one another with the cap flange (stem) extending outwardly therefrom). In the exemplary cylindrical feeder device 310, the feed track 314 has a spiral orientation.

Because of its bowl-like configuration, the cap feeder device 310 has a generally annular shape and includes a feeder discharge (exit port) formed as part of the exit mechanism along an outer periphery thereof to permit the caps 40 to exit the reservoir once the caps 40 have been arranged in the desired orientation by the orientation tooling. As just mentioned, the syringes should exit the cap feeder device 310 such that base portion faces the transport system. In fact, as the caps exit, the base portion that extends across the flange is disposed on one side of a rail so as to locate and restrict the free movement of the caps as they are fed out of the cap feeder device 310. For example, the rail prevents lateral movement of the caps since if the caps moved laterally, the structure of the cap would strike the rail 314 and thereby prevent any additional lateral movement.

As with the syringe feeder device, the cap feeder device is operatively connected to a transport station 320 that is an extension of the exit rail of the cap feeder device 310 and any number of different transport mechanisms can be used so long as the mechanism is designed to receive the caps 40 in the desired orientation and segregated manner and then deliver the caps 40 to the next downstream station. One exemplary transport mechanism is a feeder rail 320 that has a drive feature for assisting in advancing the caps from one end to the second end, while maintaining the caps in their desired orientation. The feeder rail 320 can be an in-line track that with a straight line drive unit that is designed to produce linear vibratory motion that acts to covey parts horizontally from the feeder discharge located at or proximate the first end to the second end where the syringes 10 are then delivered to another station. The feeder rail 320 accepts only syringes that are properly positioned.

For example, one exemplary feeder rail 320 has a declined ramp in the form of a rail structure on which the caps are contained as they move from the first end to the second end. In addition a guide rail 322 serves to maintain the caps 40 in desired orientations since it prevents extensive unwanted movement of the caps on the rail as the caps move from the one end to the other end. Since the floor is declined (ramped down), the caps will slide under gravity down the feeder rail towards the second end and as a result of the vibratory action.

Figure 6:
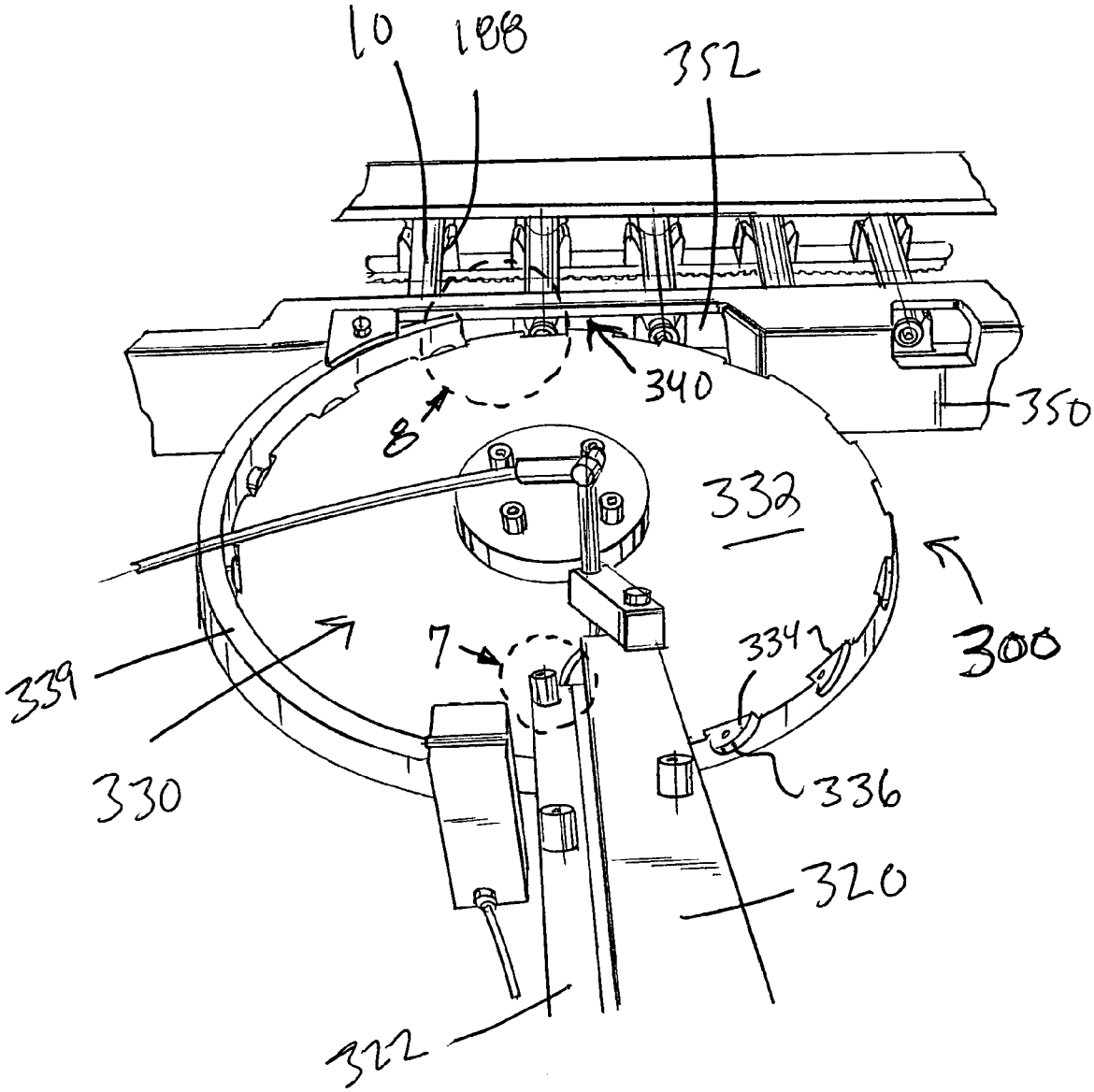
FIG. 6 is a top perspective view of a cap placement station for placing a cap on an empty syringe barrel as it is carried by the transportation mechanism.
Figure 10:
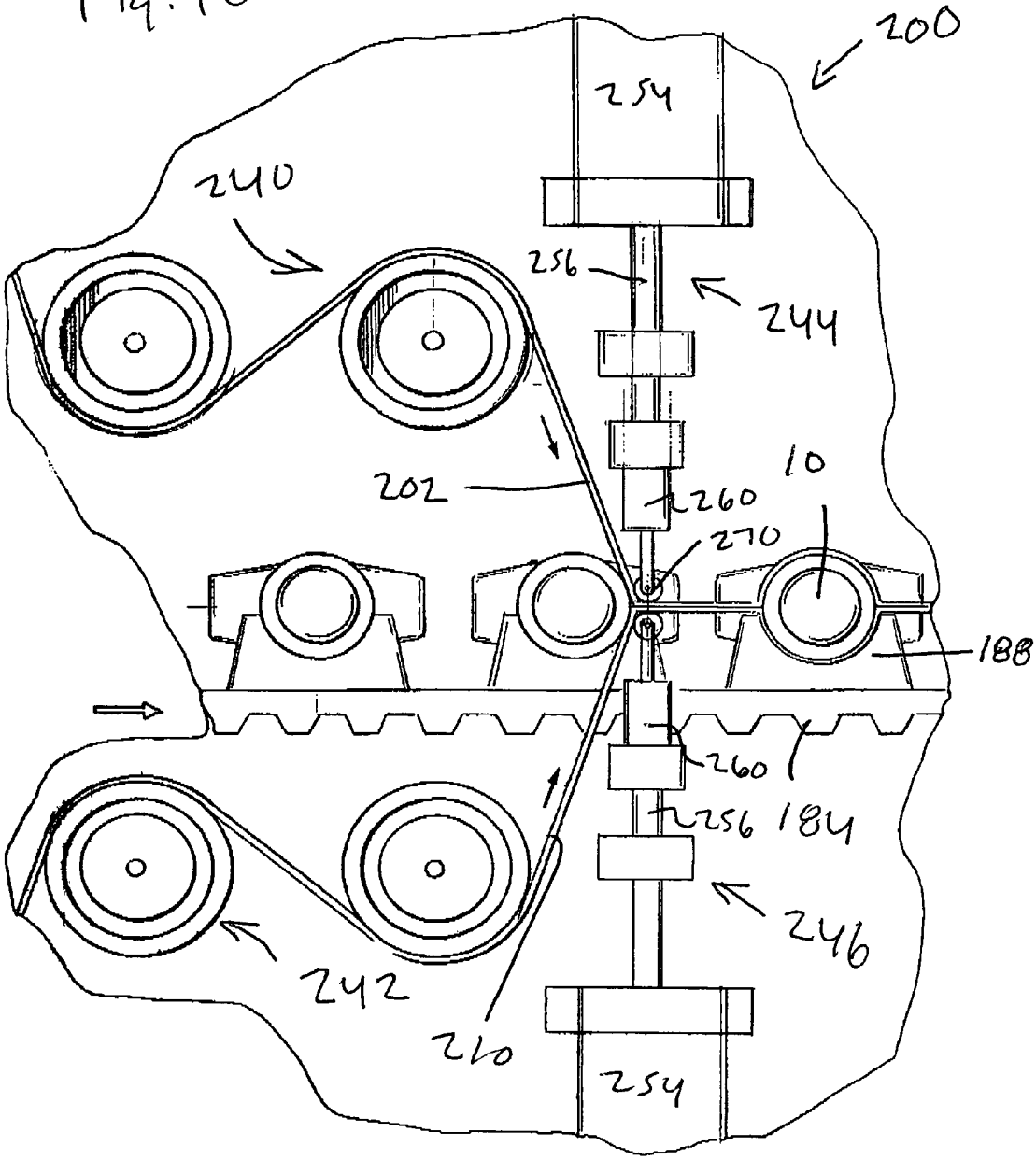
FIG. 10 is a side elevation view of the web application station illustrating a tape applicator mechanism in a first position.
Figure 11:
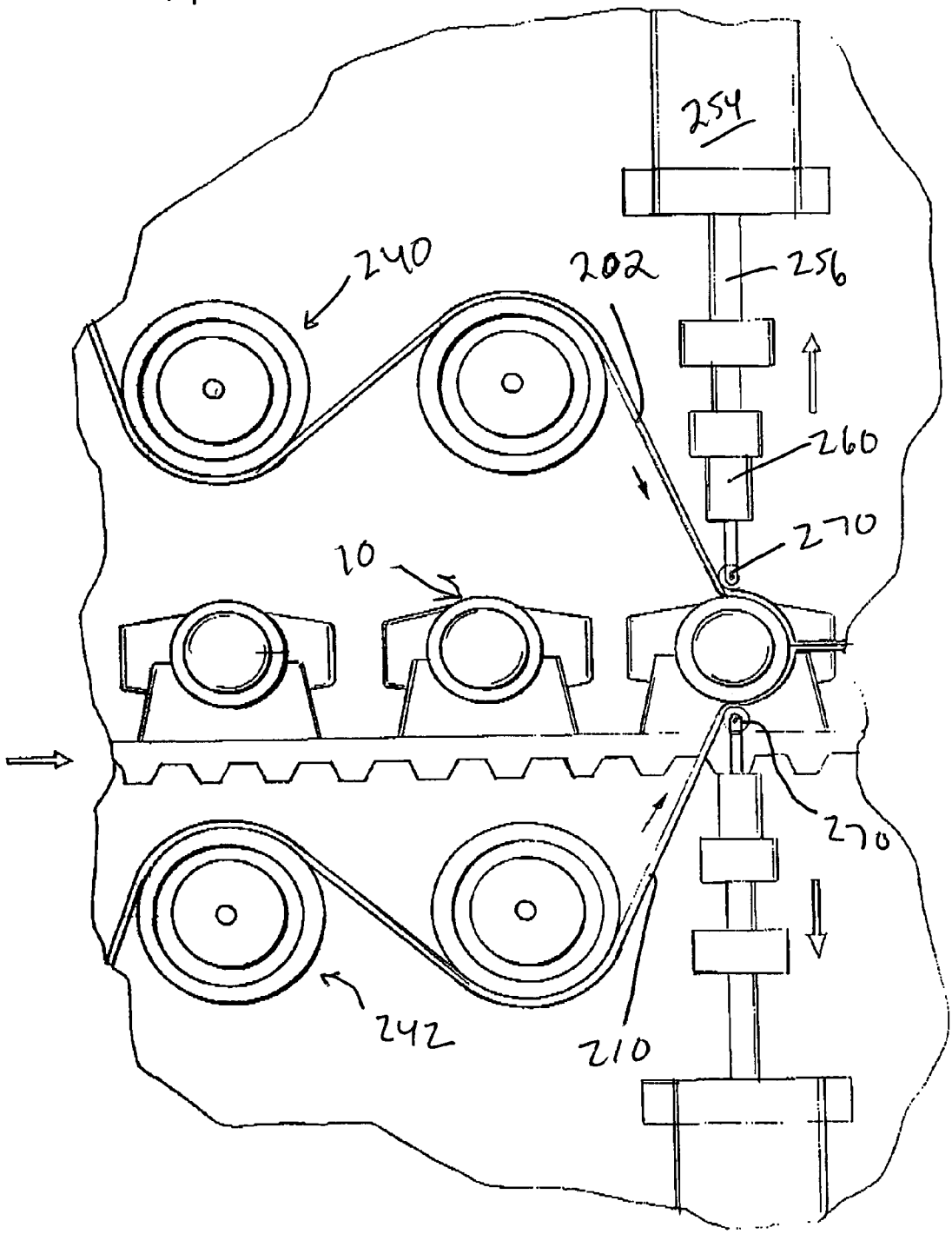
FIG. 11 is a side elevation view of the web application station illustrating the tape applicator mechanism in a second position.
Figure 12:
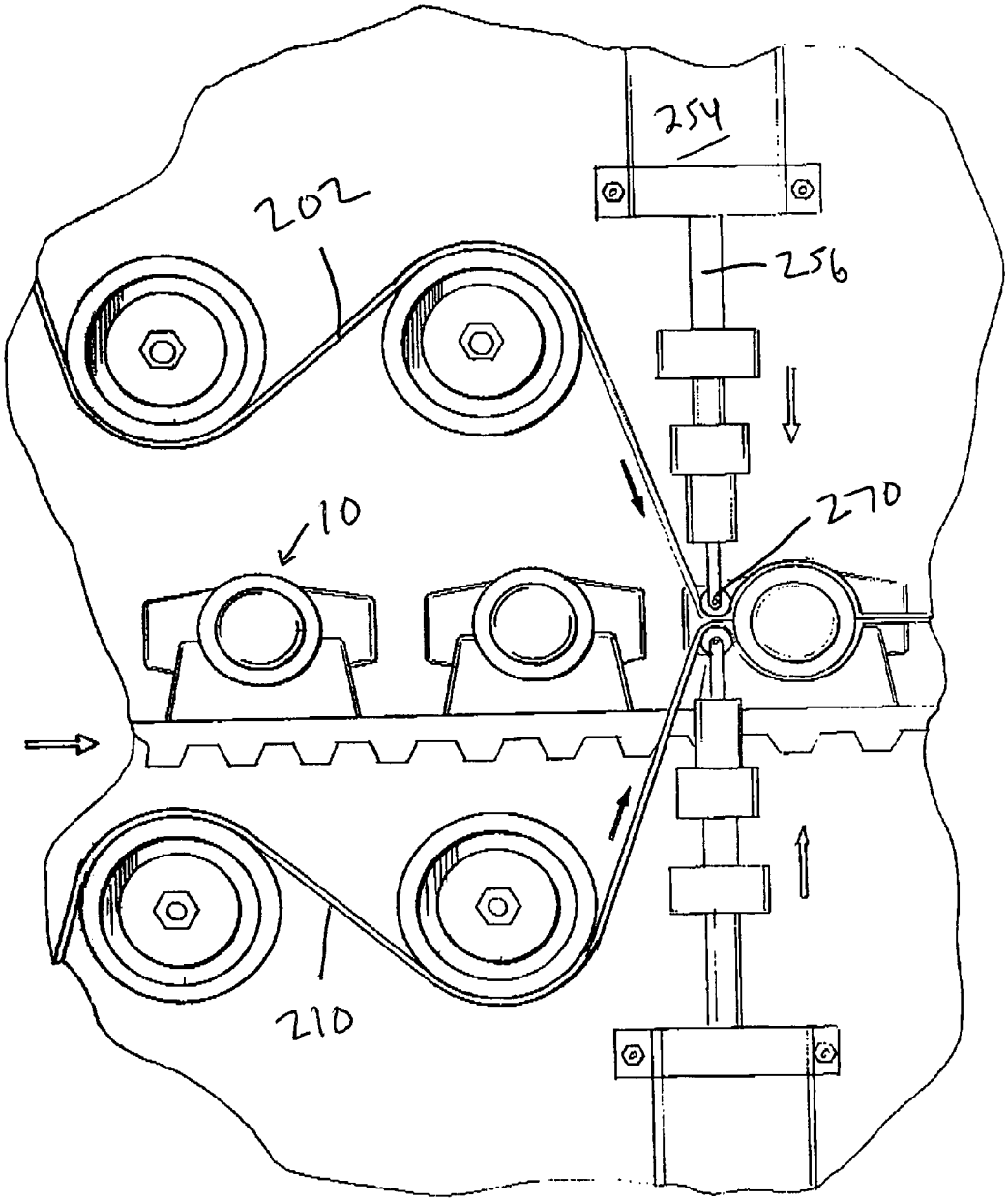
FIG. 12 is a perspective view of the web application station illustrating the tape applicator mechanism in a third position.
Figure 13:
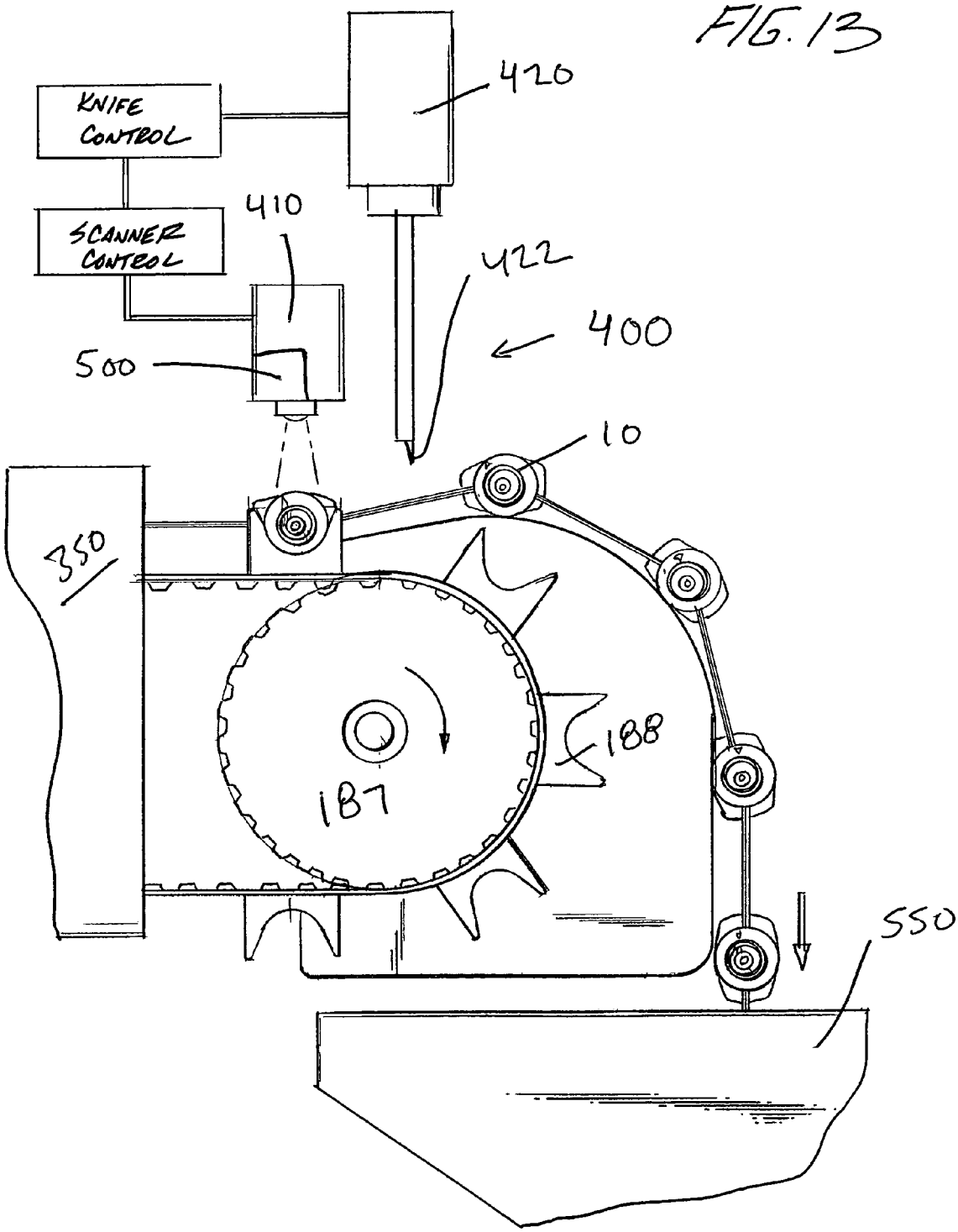
FIG. 13 is a side elevation view of a downstream station including a syringe counter, a scanner and a cutting device, with the cutting device show in a retracted position.
Figure 14:
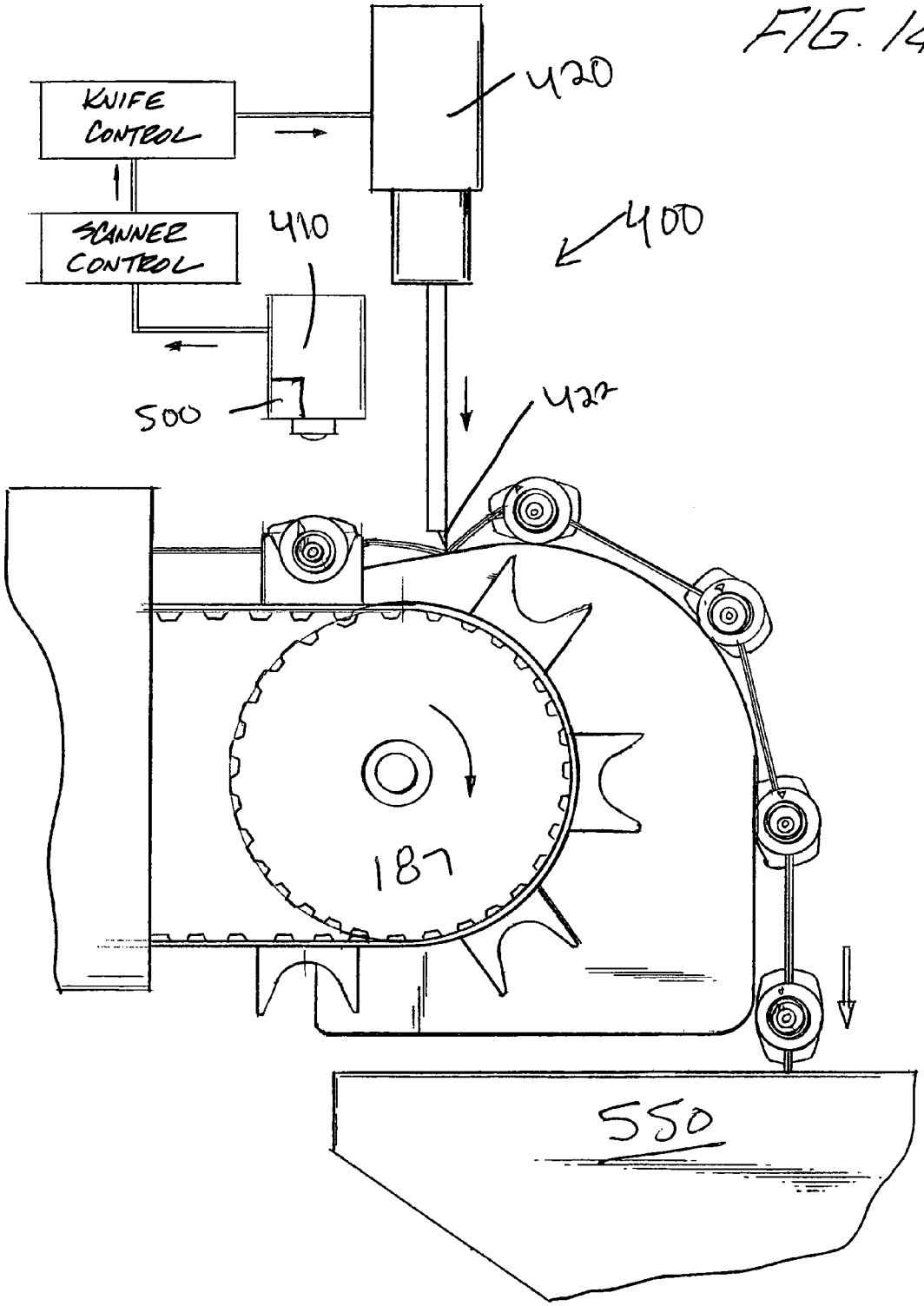
FIG. 14 is a side elevation view of the station of FIG. 13 with the cutting device in an extended cutting position.

The transport station 320 is operatively coupled to an index station 330 and more specifically, the transport mechanism cooperates with a guide receiving feature formed as part of the index station 330 for receiving and holding the caps. Referring to FIGS. 1 and 6, the index station is similar to index station 160 and includes a rotary dial 332 that has a number of guide receiving features that are formed radially around the outer periphery of the rotary dial 332. More specifically, the rotary dial 332 has a first face and an opposing second face with the discrete features 334 extending on the outer peripheral edge from the first face 331 to the second face 333. The rotary dial 332 is mounted so that it is substantially perpendicular to the other rotary dial 162 and such that the circumferential edge of the rotary dial 332 faces the barrel tip of the syringes 10 so as to permit the feeding of the caps to the empty barrel tips.

As best shown in FIG. 6, the rotary device includes a number of the cap receiving features 334 that are formed along the edge of the rotary dial 332. The cap receiving features formed in the circumferential edge are in the form of shaped notches that receive and hold the caps by their top base portions as explained below and as a result of an applied vacuum. More specifically, the circumferential edge of the rotary device 332 includes a plurality of spaced, shaped notches 334 formed therein for receiving, capturing and retaining the caps 40. The exemplary notches shown in the Figures are open at an upper rim of the circumferential edge and terminate in a rounded closed section 336 that is proximate to but not at a lower rim of the circumferential edge. In one embodiment, the notch is generally U-shaped with the upper open portion of the notch being a widened section of the notch that is oversized relative to the other portions of the notch so as to permit easy reception of the cap therein and the rounded closed section 336 of the notch serves to capture the cap after it has been disposed within the notch since the rounded closed section is complementary to the shape of the cap, and more particularly, to the annular base section.

In another aspect, the rotary device is operatively coupled to a vacuum source. The vacuum source is actuated so that the vacuum is applied to the rotary dial 332 at least in the notches 334 that are to receive and retain caps 40. In one embodiment, each notch 334 includes one or more vacuum ports 338. The vacuum source is of a sufficient strength to securely hold the cap within the notch even as the vacuum dial 332 is rotated and the position of the cap 40 is varied relative to the surrounding components and the ground surface. Preferably, the programmable controller and the vacuum dial 332 are of the type that permit the vacuum ports in individual notches 334 to be controlled so that the vacuum source in particular notches 334 can be either turned on or turned off. The vacuum dial 332 is therefore advanced in an indexed manner to permit additional caps to be received within the notches 334 of the index dial 332.

In the exemplary embodiment, the vacuum dial 332 is advanced in a clockwise direction; however, it will be understood that the system can be configured so that the vacuum dial 332 rotates in the opposite direction. As the vacuum dial 332 rotates, the caps held within the notches 334 by the applied vacuum are advanced in a direction toward the next station, namely a cap placement station 340. A protective rail 339 can be provided at least partially around a length of the circumferential edge of the rotary dial 332. In one exemplary embodiment, the caps 40 are fed onto the vacuum rotary dial 332 at about the 5 or 6 o'clock positions (FIG. 7) and then extend around to about the 11 o'clock position (FIGS. 8 and 9), wherein the caps are disengaged from the rotary dial 332 and into engagement with the syringe 10 such that the cap is frictionally held onto the open barrel tip of the syringe as explained below. The caps 40 are thus disposed between the protective rail 339 and the rotary dial as they rotate thereabout.

In one embodiment, there are two side guide rails 350 that are spaced apart such that the belts 184, 185 are disposed between the two side guide rails 350 as shown in FIG. 1. In the illustrated embodiment, each guide rail 350 is in the form of a U or C-shaped bracket that is orientated so that the open channel section thereof faces the belts 184, 185. In other words, the leg portions of the bracket are formed on opposite sides of belts 184, 185. At the cap replacement station 340, a cut out 352 is formed in one of the side guide rails 350 to provide access to the syringes 10 that are held within the members 188. The cut out 352 can be in the shape of a rectangle. The vacuum rotary dial 332 is disposed next to the side guide rail 350 such that are the rotary dial 332 rotates, the dial 332 is close to or can even extend at least partially into the cut out 352.

The captured cap rotates to about the 11 o'clock position and the relative positioning of the vacuum rotary dial 332 to the nested syringe 10 causes a leading edge of the cap to come into contact with the empty barrel tip and as the rotary dial 332 rotates, it is indexed in a coordinated manner with the driving of the belts 184, 185 such that one cap and one syringe are brought together at the transfer station to accommodate transfer of the cap to the syringe barrel. In other words, a next-in-line cap and a next-in-line syringe are brought together at the transfer location as a result of angling and correctly positioning the devices relative to one another. The leading edge of the cap is first pressed on or otherwise engages the barrel tip (e.g., at about the 11 o'clock position) and as the rotary dial rotates further, the cap is physically brought closer to the barrel tip, thereby causing the tip cap to be mated onto (frictional fit) with the barrel tip as in a snap fit manner. As the cap passes through the 12 o'clock position, it then begins to be directed way from the syringe; however, at this point the only thing that remains is to frictionally fit the trailing edge of the cap onto the barrel tip. This is accomplished by the rotation of the rotary dial and the relative movement of the belts 184, 185 that carry the syringe 10 that is being fitted with a tip cap. Thus, the trailing edge is then mated with the barrel tip, resulting in the tip cap being securely placed on the barrel tip. It will be appreciated that the frictional fitting that results between the cap and the barrel and the relative movements of the device 332 and belts 184, 185 overcome the strength of the vacuum that is contained in the notch 352 so as to permit the removal of the tip cap therefrom.

Thus, this station is designed to securely place the caps on the ends of the syringes prior to the syringes being further processed at the web application station 200. It can be more economical to purchase the caps separate from the syringes and then place the caps on the syringes by operating the above-described equipment. In this manner, the syringes 10 are introduced to the web application station 200 fully capped and ready to be banded so that the resulting banded product has securely attached caps.

Referring to FIGS. 1 and 10–12, the web application station 200 is the station where two web layers (e.g., tapes) are disposed on the ordered, spaced apart syringes 10 for forming a banded (bandoliered) structure. One exemplary web application station 200 includes a first web source 202 disposed on one side of the belts 184, 185 and a second web source 210 disposed on another side of the belts 184, 185.

The first web source 202 is a roll of web material that is operatively coupled to a first support member 204 and is positioned above the top surface of the belts 184, 185 such that the first web source 202 is generally disposed between the belts 184, 185. In other words, the width of the first web roll 202 is less than a distance between the belts 184, 185. The first support member 204 can be any number of types of support members so long as it can support the first web roll 202 and permit the free rotation thereof for unwinding thereof. In the illustrated embodiment, the first support member 202 is a vertical support post or beam that has a boss or the like formed at a distal end thereof. When the first web roll 352 is coupled to the support member 204, the boss is received in an opening formed through a core of the first web roll 202 that has the first web material wound therearound. The first web roll 202 is arranged so that a free end thereof is unwound from the first web roll 202 at a lower section thereof (e.g., between the 4 and 6 o'clock positions of the first web roll 202) and is directed to one face of the spaced syringe barrels 20 as described below.

Similarly, the second web source 210 is a roll of web material that is operatively coupled to a second support member 212 and is positioned below the bottom surface of the belts 184, 185 such that the second web roll 210 is disposed directly between the belts 184, 185. In the illustrated embodiment, the second support member 212 is also a vertical support post or beam that has a boss or the like formed at a distal end thereof for carrying the second web roll 210 in the manner described above. In the exemplary embodiment, the first and second support members 204, 212 are formed as a single integral vertical support post with the first member 204 being the upper half thereof and the second member 212 being the lower half thereof. The second web roll 210 is arranged so that a free end thereof is unwound from the second web roll 210 at an upper section thereof (e.g., between the 10 and 2 o'clock positions of the second web roll 210) and is directed to an opposite face of the spaced syringe barrels 20 as described below. It will be appreciated that the boss associated with the second support member 212 is disposed below the belts 184, 185 since it extends inwardly toward the belts 184, 185 and therefore, cannot come into contact thereof. Thus, the center of the second web roll 210 lies below the belts 184, 185. For simplicity, FIG. 1 does not show any additional support structure that is attached to the support members; however, it will be appreciated that an additional support structure can be attached thereto to support and hold the support members in the illustrated position. It will be appreciated that the web materials 202, 210 are fed so that the adhesive side of each web material faces a respective side of the syringe barrel 20.

Prior to the actual web application station 200, the system optionally includes a roller mechanism 230 or the like that is upstream of where the web materials 202, 210 are introduced to the syringes. The roller mechanism 230 is in the form of a roller of the like 232 that is positioned so as to contact the nested syringes as they are transported under action of the belts 184, 185. The roller is merely designed to press down any syringe 10 that may have lifted up and out of a nested position between the members 188. In other words and in some instances, the syringes are laid between the members 188 such that the syringe 10 is not fully captured between the members 188 but rather is sitting slightly high within the members 188. By applying pressure to the syringes 10 as they pass thereunderneath, the roller ensures that the syringes 10 are all pressed down between the fingers 188 and thus are uniformly positioned along the belts 184, 185 to ensure proper banding.

The web application station 200 also includes equipment for pressing the web material 202, 210 onto the syringe barrels 20 as the web material 202, 210 is dispersed and more specifically, the equipment includes a tape tension and runaway control mechanism that is formed of a first pair of idler rollers 240 that are disposed on one side of the belts 184, 185 and a second pair of idler rollers 242 that are disposed on the other side of the belts 184, 185 as well as a plurality of programmable web cam roller units, namely a first cam press 244 and a second cam press 246 that are each orientated on both sides (e.g., underneath and above) of the syringes 10. It will be appreciated that the first pair of idler rollers 240 is identical to the second pair of idler rollers 242 and primarily serve to apply tension to the web material before it is fed to the corresponding cam press 244, 246. The rollers 240, 242 also acts as a runaway control since these rollers can take up any excess material. In one embodiment, the web material 202 is wound underneath one of the rollers 240 and then is looped over the other one of the rollers 240 and then is directed down into engagement with the cam press unit 244. The other pair of rollers 242 act in the same manner and serve to tension and feed the web material 202 to the cam press unit 246.

The first cam press unit 244 is preferably of the same construction as the second cam press unit 246 and therefore, for the sake of brevity, only the first cam press unit 244 is described. It will therefore be understood that like parts are numbered alike with respect to these two cam press units 244, 246. Each of the first and second cam press units 244, 246 are programmable, automated devices that act to simultaneously apply web materials 202, 210 to opposing sides of the syringes 10 in a controlled manner so as to form banded syringes.

The first cam press unit 244 is formed of an automated cam device 250 that is operatively coupled to a drive source 252, such as a stepper motor, that serves to controllably drive the cam device 250. The cam device 250 includes a stationary base section 254 and a shaft 256 that is movable relative to the stationary base section 254 and moves between and extended position and a retracted position. The drive source 252 (e.g., stepper motor) can be controlled in a precise manner so as to incrementally move the shaft 256 in a precise manner. The shaft 256 has one end that extends into the base section 254 and is movably driven therein and an opposite end that is attached to a support member 260, such as a block. The block 260 thus travels with the shaft 256 and therefore is retracted and extended therewith. Base section 254 is in the form of a cylinder, such as a pneumatic cylinder, that includes the drivable shaft 256.

The block 260 includes a web roller 270 that is the component which receives the web material 202 from the first pair of idler rollers 240 and serves to apply the web material 202 across one side of the syringe barrel in a controlled manner as described below. The web roller 270 is preferably attached at its ends to the support block 260 via a bracket or the like, yet it is held by the support block 260 such that the roller 270 can freely rotate relative to the support block 260. It will be appreciated that the web roller 270 serves to apply the web material 202 to either the other opposing web material 210 or one half (the top half) of the syringe barrel so as to produce a banded structure.

The first and second cam roller units 244, 246 are programmably synchronized such that in an initial first position, the shafts 256 and therefore the support blocks 260 and the web rollers 270 associated with the first and second cam roller units 244, 246, are in extended positions and therefore, the web rollers 270 are at their closest point with respect to one another. In this initial position, the web rollers 270 pinch the web materials 202, 210 together at a location adjacent the next-to-be banded syringe 10. In this manner, the web materials 202, 210 are cleanly mated with one another and joined together across their widths. The drive source (stepper motor) operates and controls movement of the cam roller units in the synchronized manner such that the cam roller units move in a cycle that is continuously repeated. More specifically, the stepper motor 252 drives the cam units 244, 246 with a high degree of precision such that the degree of motion of the shafts 256 is controlled with a high degree of precision. The shafts 256 are moved in a controlled in (extended) and out (retracted) manner with respect to one another so as to cause the web roller 270 to move from an initial maximum extended position (e.g., 3 o'clock position in FIG. 10) to a maximum retracted position (12 o'clock position in FIG. 11) and then returns to the maximum extended position (e.g., 9 o'clock position in FIG. 12) and this constitutes one cycle for the web roller 270.

In other words, after the initial position where the web rollers 270 are in the fully extended position and the web materials 202, 210 are pinched together, the shafts are driven a prescribed distance away from the syringe, thereby driving the web rollers 270 in the same direction away from the syringe; however, one will appreciate that at the same time, the belts 184, 185 are being driven resulting in the syringes 10 being moved in a longitudinal direction that is perpendicular to the axial direction of movement of the cam shafts 256. Thus, the retraction of the web roller 270 accommodates the longitudinal movement of the syringes 10 and provides the necessary clearance therefore and it will be appreciated that the simultaneous retraction of the web rollers 270 and the axial movement of the syringes 10 in effect results in the web rollers 270 applying or "rolling" and adhering the web materials 202, 210 to the opposing surfaces of barrel up to a point or apex which represents the maximum radial distance between the outer syringe surface and a center line through the syringe barrel. The web material is thus rolled up one surface (a leading face) of the barrel body to the apex which represents the point at which the web rollers 270 are farthest apart from one another (the end of the retraction part of the cycle) and then the web rollers 270 begin the extension part of the drive cycle in that the web rollers 270 are driven by towards one another. The continued axial movement of the syringes 10 and the extension of the web rollers 270 serve to apply the web material to the trailing surface of the syringes 10 until the web materials 202, 210 are bough back into contact at the end of the extension part of the cycle, thereby completing one cycle and serving to simultaneously and at the same location apply two layers of web material. In this manner, the web materials 202, 210 are applied to the syringes 10 to form the banded structure shown in FIG. 15.

The drive source is preferably in the form of a stepper motor since, as is well known, a stepper motor can be controlled with great precision and this is translated to control the degree (distance) and direction of movement of the web rollers 270 so as to provide the banded structure. For example, the stepper motor can be driven only a small number of steps which corresponds to the web roller only moving a small distance. On the other hand, the stepper motor can be driven a larger number of steps which results in the web roller being moved a much greater distance.

The stepper motor cycle is repeated over and over as the belts 184, 185 advance which results in the web materials 202, 210 being banded to each other in sections surrounding the syringe 10 and being banded directly to the syringe 10 itself. In other words, the action of the stepper motors cause the respective cam units moving in a repeated cyclical manner resulting in the web materials 202, 210 being simultaneously brought together and banded to produce the bandoliered web structure shown in FIG. 15. In sum, the synchronized action of the first and second cam roller units 244, 246 serves to apply web materials 202, 210 simultaneously to two opposite sides of the syringes 10 at the same location as the syringes 10 are transported by the driving action of the first and second belts 184, 185.

The web material is preferably a thin flexible film and therefore, when the two opposing web materials are attached to one another, the interconnected web section between the syringe barrels 20 is flexible, thereby permitting the web section to be readily bent or folded between the syringe barrels 20. This permits the bandoliered syringes to be disposed in packaging or the like in a folded, stacked manner.

Optionally, the system 100 includes a number of locating and guide features that help initially align and hold the web material. For example, web guides and retainers (not shown) can be disposed proximate to the first and second cam roller units 244, 246, respectively. In one embodiment, the retainers are in the form of clip members that initially grasp the web materials prior to the materials being applied to the first syringe. After the activation of the first and second cam roller units 244, 246, the web guides and retainers are not needed since the banding of the syringes has begun and the loose ends of the web materials 202, 210 are securely attached to one another. As a result, a cutting device or the like can be used or the retainers can have a release mechanism for releasing the web materials 202, 210, thereby permitting the advancement of the syringes 10.

Optionally, the system 100 also includes a mechanism (not shown) for ensuring that the just bandoliered syringes remain held between the fingers 188 and against the belts 184, 185 as they are advanced away from the web application station 200. The mechanism is thus designed to apply a sufficient force to the bandoliered structure to ensure that the bandoliered structure does not lift off or otherwise become dislodged from its position along the belts 184, 185 and within the fingers 188. One exemplary mechanism contacts and applies a slight force against the syringe barrels 20 that were just bandoliered in the web application station 200 that is upstream therefrom. The mechanism can be of the same type of device as roller mechanism 230 in that the roller mechanism is formed of a roller (roller 232) that applies slight pressure to the just bandoliered syringes 10. The mechanism is located so that it holds the syringes 10 that were just bandoliered because this is the location where it is most undesirable to have any sort of lifting of the syringes 10 away from the belts 184, 185 since lifting of the syringes 10 in this location can result in the lifting of the web materials 202, 210 in the tape application station 200 which is undesirable since it can lead to improper alignment of the web materials 202, 210 during the web pressing operation.

The belts 184, 185 continue to the end that is opposite the end that where the index station 160 is located. At this end, the bandoliered syringes 10 can be further processed or manipulated in any number of different ways. For example, the bandoliered syringes 10 can be sent to a packaging station for packaging of the empty bandoliered syringes 10 or the syringes 10 can be delivered to an automated system where the syringes 10 can be filled with a medication or the like.

According to one exemplary embodiment, the system 100 includes a syringe counter and cutter station 400 disposed at the ends of the belts 184, 185. The station 400 includes equipment that serves several different purposes, namely, an automated counter 410 that serves to detect and store a running total of the number of banded syringes that pass thereby. The counter 410 can be in the form of any type of device that can perform this counting operation and in one embodiment, the counter 410 is a photo eye that serves to count the syringes 10 as they pass by. By detecting and recording with the counter 410 a running total of the number of syringes 10 that have passed thereby, packaging requirements can easily be tracked. For example, the banded syringes 10 are usually packaged in a prescribed quantity per package and therefore, it is important for the system to deliver precisely only the prescribed quantity of syringes 10 that are earmarked for this particular package. In other words, if the package or syringe container is to include 500 banded syringes, then the counter 410 will keep track of the first syringe that is delivered into the new package and once the counter detects that 500 syringes have passed, the counter 410 signals the master controller and certain actions are taken to ensure that only 500 banded syringes are delivered into the packaging. It will be appreciated that the number of banded syringes is not limited to being 500 since this is merely exemplary in nature and not limiting. In other words, the bandolier can include any number, such as 100, 250, 300 or 400, of syringes that are banded together.

For example, the station 400 also preferably includes a cutting device (knife, etc.) or the like 420 that includes a cutting blade 422. This device 420 is preferably an automated device that is operatively connected to the other working components as well as to the master controller. When actuated, the cutter 420 is directed downward towards the banded syringes 10 and the blade 422 makes contact with an pierces through a section of the joined web materials 202, 210 that lies between two adjacent syringes resulting in the joined web materials 202, 210 being cut. There are a number of different reasons why the banded syringe structure needs to be cut, including but not limited to cutting the banded structure at a location that ensures that the joined banded syringe structure includes the correct number of syringes. In other words, the cutter 420 is used to correctly size the banded syringe structure so that it contains a prescribed number of syringes. The prescribed number of syringes that are to be banded will vary from application to application; and in some instances can be as little as several syringes or so or as large as 500 or so syringes. The movement of the cutter 420 can be controlled in a number of different manners, including but not limited to the operation of a pneumatic device that controllable drives the cutter 420 on command causing the blade 422 to cut through the joined web materials 202, 210 and introducing a break in the banded syringe structure.

Moreover, a vision detection device 500 is preferably located at station 400 for determining whether any of the banded syringes 10 are damaged or otherwise unfit for loading into the packaging that lies downstream therefrom at packaging station 550. The vision detection device 500 is preferably a standard optical (character) recognition device which has a sensor or the like (optical sensor) that serves to take an image of one banded syringe at a time and then the image is compared with images stored in a database using standard optical (character) recognition software to determine whether the captured image depicts an acceptable syringe that can be sent downstream and into the appropriate packaging for consumer distribution or whether the captured image depicts a syringe that for some reason is unacceptable for packaging and requires some type of remedial action to be taken. Typically, the remedial action includes removing the rejected syringe from the banded structure. For example, the rejected syringe can be cut out of the banded syringe structure by a cutting device, which can be the same one shown at 420, and then after removal of the rejected syringe, the subsequent banded syringes (those downstream from the rejected one) pass across the sensor for inspection thereby and if they are in acceptable form, the syringes 10 are delivered to the packaging station 550.

The optical (character) recognition software generally works in the following manner. The image of the syringe captured by the sensor is compared to images in the database and more particularly, the captured image is compared to an image of a "pristine condition" syringe that serves as the benchmark in the comparison. Classical character recognition software is capable of determining whether there are any inconsistencies or differences in the appearance of the syringe in the captured image compared to the syringe that is depicted in the stored image, and if any difference is detected, a signal is delivered from the vision detection device 500 to the master controller which then can take appropriate remedial actions, which might entail stopping or slowing down the speed of the belts 184, 185 to ensure that the rejected syringe is not delivered to the packaging station 550 and further remedial action to remove the rejected syringe, such as the cutting technique described above. There are a number of different reasons as to why the syringe might be defective or otherwise classified as being rejected, including structural defects to either the syringe and/or the cap or operational miscues, such as a cap being either absent or not completely on the syringe barrel. For example, a cap may be cracked or otherwise fractured or the cap may have not been completely placed on the syringe barrel 20 at the cap placement station 300. Since the banded syringes should all be uniformly sound for subsequent processing, these types of defects can not go unnoticed since it can lead to equipment malfunction (e.g., jamming), medication leakage, etc.

It will be appreciated that the sensor may actually entail two sensors, one sensor that captures an image of the top half of the banded syringe and a second syringe that captures an image of the bottom half of the syringe since the flaw or reason for rejecting the syringe might lie in the bottom half of the syringe such that a sensor directed to the top half would not detect such defect, etc.

Figure 16:
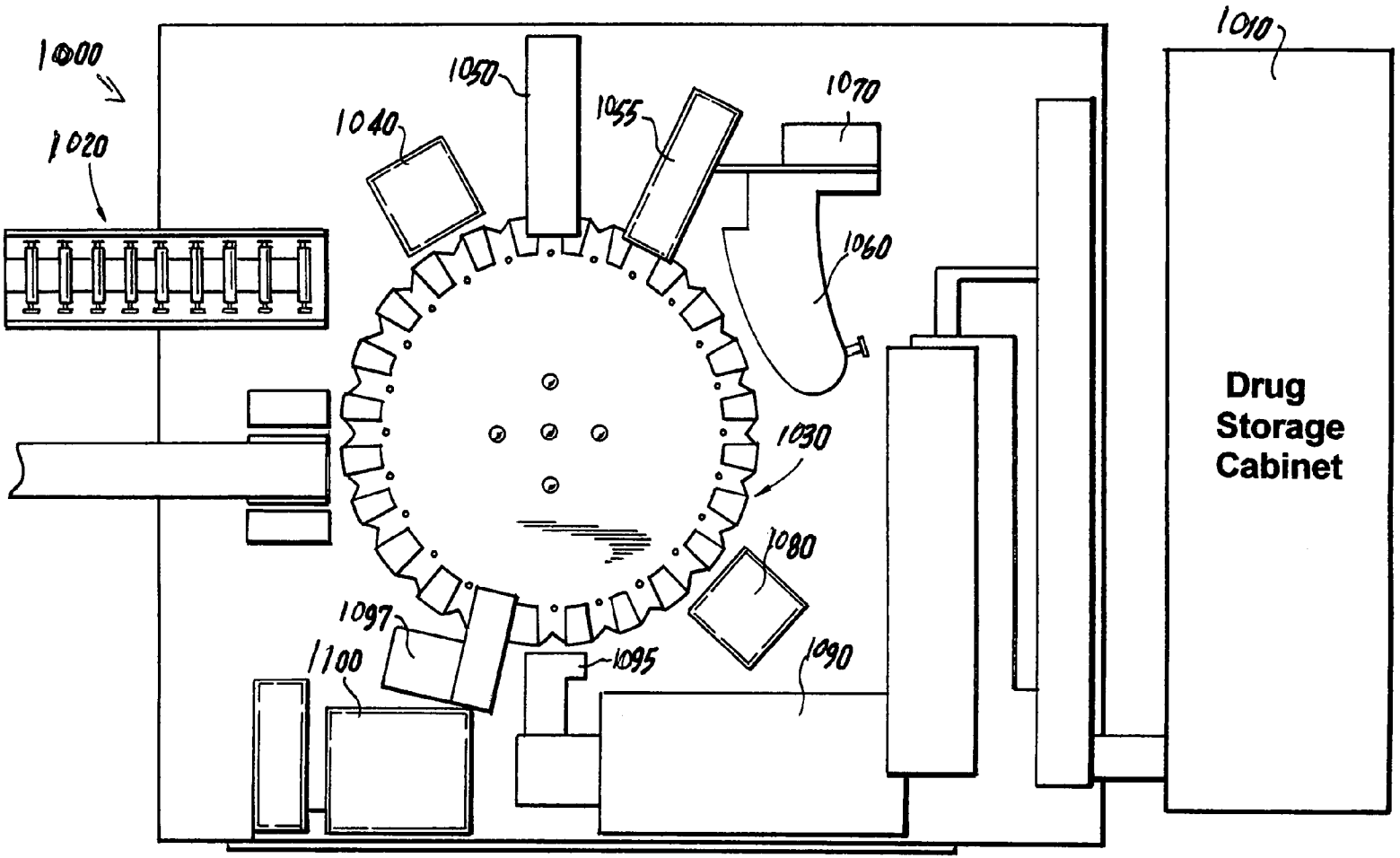
FIG. 16 is a diagrammatic plan view of an automated system for preparing or otherwise compounding a medication to be administered to a patient

In one exemplary application, the system 100 is used in combination with the automated system 1000 of FIG. 16 that receives the bandoliered syringes and further processes them according to specific instructions that are inputted by an operator. FIG. 16 is a schematic diagram illustrating one exemplary automated system, generally indicated at 1000, for the preparation of a medication, which is described in great detail in commonly assigned U.S. patent application Ser. No. 09/998,905, entitled Automated Drug Vial Safety Cap Removal, filed Nov. 30, 2001, which is hereby incorporated by reference in its entirety. The automated system 1000 is divided into a number of stations where a specific task is performed based on the automated system 1000 receiving user input instructions, processing these instructions and then preparing or compounding unit doses of one or more medications in accordance with the instructions. The automated system 1000 includes a station 1010 where medications and other substances used in the preparation process are stored. As used herein, the term "medication" refers to a medicinal preparation for administration to a patient. Often, the medication is initially stored as a solid, e.g., a powder, to which a liquid or fluid diluent is added to form a medicinal composition. Thus, the station 1010 functions as a storage unit for storing one or more medications, etc. under proper storage conditions. Typically, medications and the like are stored in sealed containers, such as vials, that are labeled to clearly indicate the contents of each vial.

A first station 1020 is a banded syringe preparation station that houses and stores a number of syringes and is described in great detail hereinafter. In one exemplary embodiment, the syringes are provided as a bandolier structure that permits the syringes to be fed into the other components of the system 1000 using standard delivery techniques, such as a conveyor belt, guidance mechanism, etc.

The system 1000 also includes a rotary apparatus (dial) 1030 for advancing the fed syringes from and to various stations of the system 1000. A number of the stations are arranged circumferentially around the rotary apparatus 1030 so that the syringe is first loaded at a first station 1040 and then rotated a predetermined distance to a next station, etc. as the medication preparation or compounding process advances. At each station, a different operation is performed with the end result being that a unit dose of medication is disposed within the syringe that is then ready to be administered.

One exemplary type of rotary apparatus 1030 is a multiple station cam-indexing dial that is adapted to perform material handling operations. The indexer is configured to have multiple stations positioned thereabout with individual nests for each station position. One syringe is held within one nest using any number of suitable techniques, including opposing spring-loaded fingers that act to clamp the syringe in its respective nest. The indexer permits the rotary apparatus 1030 to be advanced at specific intervals.

At the second station 1040, the syringes are loaded into one of the nests of the rotary apparatus 1030. One syringe is loaded into one nest of the rotary apparatus 1030 in which the syringe is securely held in place. The system 1000 preferably includes additional mechanisms for preparing the syringe for use, such as removing a tip cap at a third station 1050 and extending a plunger of the syringe at another station 1055. At this point, the syringe is ready to be filled.

The system 1000 also preferably includes a reading device (not shown) that is capable of reading a label disposed on the sealed container containing the medication. The label is read using any number of suitable reader/scanner devices, such as a bar code reader, etc., so as to confirm that the proper medication has been selected from the storage unit of the station 1010 (this function is preferably part of the labeled station in FIG. 14). Multiple readers, sensors, or other methods can be employed in the system at various locations to confirm the accuracy of the entire process. Once the system 1000 confirms that the sealed container that has been selected contains the proper medication, the container is delivered to a fourth station 1060 using an automated mechanism, such a robotic gripping device as will be described in greater detail. At the fourth station 1060, the vial is prepared by removing the safety cap from the sealed container and then cleaning the exposed end of the vial. Preferably, the safety cap is removed on a deck of the automated system 1000 having a controlled environment. In this manner, the safety cap is removed just-in-time for use.

The system 1000 also preferably includes a fifth station 1070 for injecting a diluent into the medication contained in the sealed container and then subsequently mixing the medication and the diluent to form the medication composition that is to be disposed into the prepared syringe. At a fluid transfer station, the prepared medication composition is withdrawn from the container (i.e., vial) and is then disposed into the syringe. For example, a cannula can be inserted into the sealed vial and the medication composition then aspirated into a cannula set. The cannula is then withdrawn from the vial and positioned using the rotary apparatus 1030 in line with (above, below, etc.) the syringe. The unit dose of the medication composition is then delivered to the syringe, as well as additional diluent if necessary or desired. The tip cap is then placed back on the syringe at a sixth station 1080. A seventh station 1095 prints and applies a label to the syringe and a device, such as a reader, can be used to verify that this label is placed in a correct location and the printing thereon is readable. Also, the reader can confirm that the label properly identifies the medication composition that is contained in the syringe. The syringe is then unloaded from the rotary apparatus 1030 at an unloading station 1100 and delivered to a predetermined location, such as a new order bin, a conveyor, a sorting device, or a reject bin. The delivery of the syringe can be accomplished using a standard conveyor or other type of apparatus. If the syringe is provided as a part of the previously-mentioned syringe bandolier, the bandolier is cut prior at a station 1097 located prior to the unloading station 1100.

The system 1000 preferably includes additional devices for preparing the syringe for use, such as removing a tip cap 40 of the syringe at a third station 1050 and then placing or parking the tip cap 40 on the dial (rotary device) 1030 of the automated system 1000 having a controlled environment. In this manner, the tip cap 40 is removed just-in-time for use. The tip cap 40 is then placed back on the syringe at the sixth station 1080. Additional details of the system 1000 are disclosed in the above-referenced patent application.

It will be appreciated by persons skilled in the art that the present invention is not limited to the embodiments described thus far with reference to the accompanying drawings; rather the present invention is limited only by the following claims.

What is claimed is:

1. A method of banding a plurality of syringes comprising the steps of:

introducing the plurality of syringes into a feeder;

aligning the plurality of syringes in a predetermined arrangement and delivering the aligned syringes to a rotary device;

advancing and controlling the rotary device so that syringes held therein are successively delivered to a transport device that holds and maintains the syringes in a spaced relationship, placing a cap, in an automated manner, on an empty syringe barrel as it is advanced and carried by the transport device;

advancing the transport device such that the syringes are delivered to a web application device;

activating the web application device to cause a first web material to be applied to a first face of the syringes and a second web material to be applied to a second face of the syringes, the first and second web materials being simultaneously applied at substantially the same point, wherein the first and second web materials are joined together in areas between the syringes so as to form a banded syringe structure; and advancing the banded syringe structure from the web application device.

2. The method of claim 1, wherein advancing the indexed device includes the step of advancing the indexed device one interval, while simultaneously advancing the transport device one unit such that the syringe departing the indexed device is transferred into an empty pocket formed along the transport device for retaining and holding the one syringe.

3. The method of claim 1, wherein the web application device comprises activating the web application device comprises at least two cam press units that are disposed on opposite sides of the transport device such that the two cam press units simultaneously apply the first web material and the second web material and the step of activating the web application device includes the steps of:

moving the at least two cam press units in a synchronized reciprocating cyclical manner and in a direction that is substantially perpendicular to a direction of travel of the syringes carried by the transport device, whereby the continuous movement of the syringes and the reciprocating action of the cam press units results in the web materials being pinched together at locations between the syringes and rolled and adhered along the faces of the syringe to produce the banded structure.

4. The method of claim 1, wherein the step of placing the cap includes the steps of:

introducing a plurality of syringe caps into a feeder;

aligning the plurality of syringe caps in a predetermined arrangement and delivering the aligned syringe caps to a rotary device;

advancing and controlling the rotary device so that syringe caps held therein are successively delivered to the transport device that holds and maintains the syringes in a spaced relationship such that the caps are successively frictionally fitted onto empty syringe barrel tips.

5. The method of claim 1, further including the steps of:

counting the number of syringes in the banded structure with an automated counter at a station downstream of the web application station; and as soon as the number of counted syringes reaches a threshold value, a cutting device cuts the joined web materials between adjacent syringes.

6. The method of claim 1, further including the step of:

providing an optical sensor at location downstream of the web application station, the optical sensor being operatively coupled to a controller that includes optical character recognition software;

capturing an image of a target syringe that is part of the banded structure;

comparing the captured image with a stored image of a pristine syringe using the optical character recognition software; and if a defect is detected based on the comparison of the two images, then the handling of the banded syringes is influenced.

7. The method of claim 6, wherein the defect is the presence of an improperly seated cap on the syringe barrel and the method further includes the step of:

cutting the joined web materials at two locations on opposite sides of the syringe that includes the defect.

8. A method of providing a banded syringe product comprising the steps of:

banding a plurality of syringes by aligning the plurality of syringes in a predetermined arrangement and simultaneously applying a first web material to a first face of the syringes and a second material to a second face of the syringes and pressing the first and second webs into contact with the syringes and into contact with each other in areas between the syringes so as to form a plurality of banded syringes; and providing a control feature in an area between the syringes, the control feature being different from the surrounding web material.

9. The method of claim 8, wherein the control feature is an aperture formed in the web material.

10. The method of claim 8, wherein there is a correlation between a location of the control feature in the prescribed interval and a type of syringe that is bound to the web material.

11. The method of claim 8, wherein the control feature is an optical feature formed on a surface of the web material.

12. The method of claim 8, further including the step of:

providing a detection system including a detector positioned to detect the control feature on the bandolier and perform a prescribed operation in response to the detection or non-detection of the control feature.

13. A system for banding a plurality of syringe barrels, the system including:

a first feed device for receiving the plurality of syringe barrels and positioning the plurality of syringes according to a predetermined orientation;

a first transfer device for transferring the plurality of syringes in the predetermined orientation to a transport device that receives and holds the syringes in a spaced relationship and moves them from one location to another location;

a web application device disposed along the transport device for simultaneously applying a first web material to a first face of a predetermined number of syringes and a second web material to a second face of the syringes at the same location such that the first and second web materials adhere to the first and second faces of the syringes, respectively, and with each other in areas between the syringes so as to form a banded syringe structure; and a mechanism that detects whether all the syringes are in the proper predetermined orientation prior to the syringes being transferred to the web application device.

14. The system of claim 13, wherein the first feed device includes a centrifugal bowl feeder that receives the plurality of syringes in a random manner and includes tooling that positions the plurality of syringes in the predetermined orientation.

15. The system of claim 13, wherein the first feed device includes a feeder rail that includes a drive feature for advancing the syringes from the exit port to the first transfer device.

16. The system of claim 15, wherein the drive feature comprises a straight line drive unit that produces linear vibratory motion that results in the syringes being advanced sequentially and horizontally along the feeder rail to the first transfer device.

17. The system of claim 13, wherein the mechanism detects whether markings formed on the syringe are facing in the desired direction and if they are not, the mechanism takes remedial action to reposition the syringe so that the markings face in the desired direction.

18. The system of claim 17, wherein the mechanism comprises a sensor device and syringe repositioning device that is configured to scan an outer surface of the syringe and determine whether the markings are facing in the desired direction and if they are not, the mechanism includes an active device that repositions the syringe so that the markings face in the desired directions identical to the surrounding syringes.

19. The system of claim 18, wherein the markings are gradations formed on the outer surface and the active device comprises a mechanism that discharges a prescribed amount of fluid toward the syringe to cause movement of the syringe from an out-of-phase position to an in-phase position where the markings face in the desired direction.

20. The system of claim 19, wherein the fluid is a stream of air and the out-of-phase position is 180 degrees offset from the in-phase position.

21. The system of claim 13, wherein the first transfer device includes a first rotary device that has a plurality of individual receiving sections that receive the syringes in a manner in which each syringe is separated from the other and held within its own receiving section as the first rotary device rotates to deliver the syringes from the feed device to the first transport device.

22. The system of claim 21, wherein the receiving sections comprise a number of grooves formed radially around an outer edge of the first rotary device, wherein a longitudinal axis that extends the length of each groove lies substantially parallel to a longitudinal axis that extends the length of the syringe as it is fed from the first feed device to the first rotary dial.

23. The system of claim 13, wherein the transport device comprises a conveyor belt assembly that receives the syringes from the transfer device and delivers them to another location, the belt assembly including a first belt and a second belt spaced therefrom with a space being formed therebetween, the first and second belts having aligned features that receive and hold the syringes in a spaced relationship with a predetermined distance between adjacent syringes.

24. The system of claim 23, wherein the aligned features comprise a plurality of fingers that are formed as part of the first belt and the second belt with each pair of fingers on the first belt being aligned with an opposite pair of fingers formed on the second belt, one syringe being nested within the two pairs of opposite fingers with a barrel of the syringe extending across the space.

25. The system of claim 24, wherein the first rotary device and the transport device are indexed devices that communicate with a controller such that as the rotary device advances the syringes held therein are successively brought into alignment with an empty pocket defined by the aligned features.

26. The system of claim 13, wherein the web application device comprises at least two cam press units that are disposed on opposite sides of the transport device such that the two cam press units simultaneously either press the first web material against the first face of the syringes and presses the second web material against the second face of the syringes at the same location or press the web materials into contact with each other in areas between the syringes so as to form the banded syringe structure.

27. The system of claim 26, wherein the at least two cam press units each has a first actuator with an associated reciprocating shaft as well as a press head being disposed at a distal end of the shaft, the press head including a rotatable web roller formed on an underside thereof facing the respective web material for contact therewith.

28. The system of claim 27, wherein the at least two cam press units are programmed to have a synchronized action in that in an initial first position, the web rollers are in fully extended positions at their closest point with respect to another with the first and second web materials being disposed therebetween such that the two web rollers pinch the web materials together at this point between adjacent syringes and wherein after the initial position, the cam press units follow a cyclical motion in which the web rollers are subsequently moved to fully retracted positions before then being moved back to the fully extended position, while at the same time that the transport device advances the non-banded syringes with respect to the cam press units, thereby causing the web rollers to effectively pinch the web materials together at locations between adjacent syringes and to roll and apply the web materials across the respective faces of the syringe to produce the banded syringe structure.

29. The system of claim 27, wherein the reciprocal motion of the cam press units is substantially perpendicular to the longitudinal driving motion of the transport device.

30. The system of claim 27, wherein the actuator includes a stepper motor and the reciprocating shaft is part of a pneumatic cylinder that is operatively coupled to the press head and the stepper motor.

31. The system of claim 13, wherein the web application device comprises at least two cam press units that are disposed on opposite sides of the transport device such that the two cam press units simultaneously press the first web material against the first face of the syringes and presses the second web material against the second face of the syringes at the same location as well as into contact with each other in areas between the syringes so as to form the banded syringe structure, the at least two cam press units moving in a synchronized reciprocating cyclical manner and in a direction that is substantially perpendicular to a direction of travel of the syringes carried by the transport device, whereby the continuous movement of the syringes and the reciprocating action of the cam press units results in the web materials being pinched together at locations between the syringes and rolled and adhered along the faces of the syringe to produce the banded structure.

32. The system of claim 13, wherein the first web source comprises a single side adhesive tape and the second web source comprises a single side adhesive tape.

33. The system of claim 13, further comprising a pair of idler roll assemblies disposed between sources of the first and second web materials and upstream of the web application device for applying and maintaining the first and second web materials, respectively, under tension.

34. The system of claim 13, further including:

a syringe counter and cutter station disposed along the transport device downstream of the web application station including an automated counter device that counts and stores in memory the number of banded syringes that pass thereby over a prescribed period.

35. The system of claim 34, wherein the counter device comprises a photo eye that is capable of detecting each syringe that passes through a scanning sector.

36. The system of claim 34, wherein the counter device and the cutter are operatively connected to a programmable controller so that once the counter device detects that the number of detected syringes equals an inputted number of syringes, the counter device sends a signal to the controller which then sends a signal to the cutter instructing the cutter to cut through the banded web materials between adjacent syringes resulting in the inputted number of banded syringes being separated from other banded syringe structures.

37. A system for banding a plurality of syringe barrels, the system including:

a first feed device for receiving the plurality of syringe barrels and positioning the plurality of syringes according to a predetermined orientation;

a first transfer device for transferring the plurality of syringes in the predetermined orientation to a transport device that receives and holds the syringes in a spaced relationship and moves them from one location to another location;

a web application device disposed along the transport device for simultaneously applying a first web material to a first face of a predetermined number of syringes and a second web material to a second face of the syringes at the same location such that the first and second web materials adhere to the first and second faces of the syringes, respectively, and with each other in areas between the syringes so as to form a banded syringe structure; and a vision safety detection station disposed along the transport device downstream of the web application station for determining whether any of the banded syringes are damaged or otherwise unfit for loading into packaging at a station downstream therefrom, wherein if the vision safety detection station detects that the syringe is damaged or unfit, then the handling of the syringes is influenced.

38. The system of claim 37, wherein the vision safety detection station includes a sensor that is operatively coupled to a controller that includes optical character recognition software, the sensor capturing an image of a target syringe that is part of the banded syringe structure and the controller serving to compare the captured syringe with a stored benchmark syringe image using the character recognition software and if any differences therebetween are detected, the controller takes remedial action that influences the handling of the banded syringe structure.

39. The system of claim 38, wherein if the captured image shows a cap that is improperly seated to the syringe, then the controller instructs the system to remove this syringe from the banded syringe structure.

40. A system for banding a plurality of syringe barrels, the system including:

a first feed device for receiving the plurality of syringe barrels and positioning the plurality of syringes according to a predetermined orientation;

a first transfer device for transferring the plurality of syringes in the predetermined orientation to a transport device that receives and holds the syringes in a spaced relationship and moves them from one location to another location;

a web application device disposed along the transport device for simultaneously applying a first web material to a first face of a predetermined number of syringes and a second web material to a second face of the syringes at the same location such that the first and second web materials adhere to the first and second faces of the syringes, respectively, and with each other in areas between the syringes so as to form a banded syringe structure; and a cap placement station having an automated device for placing caps on empty barrels of the syringes that are fed into the feed device and then delivered to the first transport device via the first transfer device.

41. The system of claim 40, wherein the cap placement station includes:

a second feed device for receiving the plurality of syringe caps and positioning the plurality of syringe caps according to a predetermined orientation; and a second transfer device for transferring the plurality of syringe caps in the predetermined orientation to the transport device that carries the plurality of syringes such that the caps are placed on the empty barrels of the syringes prior to them being delivered to the web application station.

42. The system of claim 41, wherein the second feed device includes a centrifugal bowl feeder that receives the plurality of syringe caps in a random manner and includes tooling that positions the plurality of syringe caps in the predetermined orientation and a feeder rail for receiving the syringe caps from an exit port of the bowl feeder and delivering them to the second transfer device in the predetermined orientation.

43. The system of claim 41, wherein the second transfer device includes a second rotary device that has a plurality of individual receiving sections that receive the syringe caps in a manner in which each syringe cap is separated from the other and held within its own receiving section as the second rotary device rotates to deliver the syringe caps from the second feed device to the empty barrels of the syringes being carried by the transport device.

44. The system of claim 43, wherein the receiving sections comprise a number of notches formed radially around an outer edge of the first rotary device which is in the form of a vacuum rotary device connected to a vacuum source, each of the notches having at least one vacuum port that is connected to the vacuum source such that negative pressure is selectively produced within each notch to assist in holding the syringe cap within the notch.

45. The system of claim 44, wherein the notch is open along an upper edge of the second rotary dial and an opposite closed end formed along a lower edge of the second rotary dial.

46. The system of claim 44, wherein the cap includes a closed top head portion and an open stem extending therefrom, the cap being held within the notch as a result of the top head portion being disposed and contained within the notch.

47. The system of claim 44, wherein the second rotary device is in communication with a controller that permits the vacuum source to be selectively disconnected from a selected vacuum port of one of the notches resulting in the disengagement of the syringe cap from the one notch.

48. The system of claim 44, wherein the second rotary dial and the transport device are mounted and arranged relative to one another such that the syringe cap is automatically placed on one empty syringe barrel by rotation of the second rotary dial which results in a leading edge of the cap first engaging the empty barrel and further rotation causes a trailing edge of the cap to mate with the empty barrel resulting in the cap being securely attached to the syringe.

* * * * *